US010094186B2

(12) United States Patent
Dillard et al.

(10) Patent No.: US 10,094,186 B2
(45) Date of Patent: Oct. 9, 2018

(54) CONTROLLED PRESSURE DRILLING SYSTEM WITH FLOW MEASUREMENT AND WELL CONTROL

(71) Applicant: Weatherford Technology Holdings, LLC, Houston, TX (US)

(72) Inventors: Walter S. Dillard, Houston, TX (US); Paul R. Northam, Houston, TX (US); Gerald G. George, Magnolia, TX (US); David J. Vieraitis, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 362 days.

(21) Appl. No.: 14/943,408

(22) Filed: Nov. 17, 2015

(65) Prior Publication Data

US 2016/0138351 A1 May 19, 2016

Related U.S. Application Data

(60) Provisional application No. 62/080,847, filed on Nov. 17, 2014.

(51) Int. Cl.
*E21B 21/08* (2006.01)
*E21B 33/134* (2006.01)
(Continued)

(52) U.S. Cl.
CPC ..... *E21B 21/08* (2013.01); *E21B 7/00* (2013.01); *E21B 21/106* (2013.01);
(Continued)

(58) Field of Classification Search
CPC . F16K 15/00; E21B 21/08; E21B 7/00; E21B 21/106; E21B 33/134; E21B 21/10;
(Continued)

(56) References Cited

U.S. PATENT DOCUMENTS 4,429,571 A 2/1984 Kullmann et al.
5,661,232 A 8/1997 Van Cleve et al.
(Continued)

FOREIGN PATENT DOCUMENTS

CN 201818247 U 5/2011

OTHER PUBLICATIONS

Int'l Search Report and Written Opinion in counterpart PCT Appl. PCT/US2015/061071, dated Apr. 11, 2016, 15-pgs.
(Continued)

*Primary Examiner* — Wei Wang
(74) *Attorney, Agent, or Firm* — Blank Rome, LLP

(57) ABSTRACT

A drilling system for drilling a wellbore has one or more valves or chokes to control the upstream pressure of drilling fluid flow in a controlled pressure drilling operation. A measurement is obtained of the drilling fluid flow from the wellbore. Based on the obtained measurement, the drilling fluid flow is selectively distributed with a distributor through one or more of a plurality of flowmeters, such as Coriolis meters. A reading of the drilling fluid flow is obtained from the selected flowmeter(s). Upstream pressure in the drilling fluid flow is controlled with the one or more valve based at least in part on the reading from the one or more selected flowmeters. The reading can be a flow rate, a pressure, or the like compared to capacities of the flowmeters. Additional valves downstream of the flowmeters can be controlled based on cavitation that the valves are estimated to produce.

40 Claims, 12 Drawing Sheets

(51) Int. Cl.

| | |
|---|---|
| ***E21B 33/129*** | (2006.01) |
| ***E21B 33/128*** | (2006.01) |
| ***E21B 21/10*** | (2006.01) |
| ***E21B 7/00*** | (2006.01) |

(52) U.S. Cl.
CPC ..... *E21B 33/128* (2013.01); *E21B 33/129* (2013.01); *E21B 33/1293* (2013.01); *E21B 33/134* (2013.01)

(58) Field of Classification Search
CPC ..... E21B 34/00; E21B 34/02; E21B 44/00; E21B 47/06
See application file for complete search history.

(56) References Cited

U.S. PATENT DOCUMENTS

| | | | |
|---|---|---|---|
| 2009/0223664 | A1 | 9/2009 | Hayworth |
| 2011/0198080 | A1 | 8/2011 | Demong |
| 2012/0085434 | A1 | 4/2012 | Powanda |
| 2012/0292109 | A1 | 11/2012 | Lovorn et al. |
| 2013/0068532 | A1 | 3/2013 | Bansal et al. |
| 2013/0179374 | A1 | 7/2013 | Hains et al. |
| 2013/0299240 | A1 | 11/2013 | Leuchtenberg |

OTHER PUBLICATIONS

First Examination Report in counterpart Australian Appl. 2015350124, dated Dec. 12, 2017, 3-pgs.
First Examination Report in counterpart SG Appl. 11201704024S, dated Apr. 16, 2018, 10-pgs.

CONTROLLED PRESSURE DRILLING SYSTEM WITH FLOW MEASUREMENT AND WELL CONTROL

CROSS-REFERENCE TO RELATED APPLICATIONS

This application claims the benefit of U.S. Prov. Appl. 62/080,847, filed 17 Nov. 2014, which is incorporated herein by reference.

BACKGROUND OF THE DISCLOSURE

FIG. 1 shows a closed-loop drilling system 10 according to the prior art for controlled pressure drilling. The drilling system 10 has a rotating control device (RCD) 12 from which a drill string 14, a bottom hole assembly (BHA), and a drill bit 18 extend downhole in a wellbore 16 through a formation F. The rotating control device (RCD) 12 atop the BOP contains and diverts annular drilling returns to create the closed loop of incompressible drilling fluid.

The system 10 also includes mud pumps 34, a standpipe (not shown), a mud tank 32, a mud gas separator 30, and various flow lines, as well as other conventional components. In addition to these, the drilling system 10 includes an automated choke manifold 20 that is incorporated into the other components of the system 10.

Finally, a control system 40 of the drilling system 10 is centralized and integrates hardware, software, and applications across the drilling system 10. The centralized control system 40 is used for monitoring, measuring, and controlling parameters in the drilling system 10. As such, the control system 40 can be characterized as a managed pressure drilling (MPD) control system. In this contained environment of closed-loop drilling, minute wellbore influxes or losses are detectable at the surface, and the control system 40 can analyze pressure and flow data to detect kicks, losses, and other events and can alter drilling parameters to control drilling operations in response.

The automated choke manifold 20 manages pressure and flow during drilling and is incorporated into the drilling system 10 downstream from the rotating control device 12 and upstream from the gas separator 30. The manifold 20 has chokes 22, a mass flowmeter 24, pressure sensors (not shown), a local controller (not shown) to control operation of the manifold 20, and a hydraulic power unit (not shown) and/or electric motor to actuate the chokes 22. The control system 40 is communicatively coupled to the manifold 20 and has a control panel with a user interface and processing capabilities to monitor and control the manifold 20.

The mass flowmeter 24 is used in the MPD system 10 to obtain flow rate measurements. During operations, for example, highly precise and accurate flow rate measurements are desired along an extended range of flow encountered during managed pressure drilling. However, the typical mass flowmeter 24 inherently loses accuracy at a low end of the flow measurement scale due to internal losses.

A type of flowmeter with the highest accuracy over the full range of desired flow rates is a Coriolis mass flowmeter. The Coriolis flowmeter is valued for its precision and ability to measure volumetric flow rate, mass flow rate, and fluid density simultaneously. For this reason, the flowmeter 24 of the MPD system 10 tends to use a Coriolis flowmeter rated to the highest expected flow rate.

Unfortunately, there are some disadvantages associated with the Coriolis mass flowmeter 24. For example, the fluid connections of the Coriolis mass flowmeter 24 tend to have a lower pressure rating than the rest of the equipment used in the MPD system 10. Moreover, the Coriolis flowmeter 24 is typically rated for a lower working pressure than the choke manifold 20 of the MPD system 10. In particular, the manifold 20 for the MPD system 10 as in FIG. 1 may typically be rated for up to 10,000-psi pressure. However, even though the flowmeter's pressure rating depends on its size and materials, the Coriolis flowmeter 24 is typically limited to a rating of less than 3,000-psi, and usually about 1,500 to 2,855-psi.

For these reasons, the Coriolis flowmeter 24 must be downstream of the chokes 22 due to this pressure limitation, and pressure relief equipment (not shown) is typically necessary should plugging occur in the flowmeter 24. Additionally, the Coriolis flowmeter 24 may be installed with a bypass valve 25 and pressure sensor (not shown). If a pressure limit of the flowmeter 24 is exceeded, the bypass valve 25 is actuated to bypass flow around the flowmeter 24 so drilling can continue at rates that may exceed the capacity of the flowmeter 24.

In addition to some of the physical limitations, the Coriolis mass flowmeter 24 used in MPD operations has some limitations related to its measurement capabilities. For example, even with the improved range of flow rates, the Coriolis mass flowmeter 24 still has a lower accuracy at the lower range of flow rates.

Additionally, the Coriolis mass flowmeter 24 is limited to taking measurements of fluid with low gas content. When too much gas is mixed with the liquid passing through the flowmeter 24, for example, the measurement error of the flowmeter 24 will increase.

One of the causes of rising gas content within the drilling fluid in MPD operations can be cavitation gas breakout that occurs at the choke 22. Valves, such as those used for the choke 22 to control the flow of fluids, have a certain upstream and downstream pressure ratio at which cavitation is likely to occur. This pressure ratio can be characterized by a cavitation index a, which is defined as follows:

$$\sigma = \frac{P_u - P_v}{P_u - P_d}$$

where:

$P_u$=Upstream Pressure, psig;

$P_v$=Vapor pressure for given temperature, psig;

$P_d$=Downstream Pressure, psig; and $\sigma$=Cavitation Index, dimensionless.

The cavitation index $\sigma$ can change for a valve or choke while it is partially opening or closing. While a valve is closing and flow rate is constant, for example, the cavitation index $\sigma$ drops. When the cavitation index $\sigma$ drops to a certain value, cavitating bubbles from gas breakout form within the fluid as it passes through the valve. The specific value of the cavitation index $\sigma$ at which cavitation occurs can be empirically determined and plotted for all the positions of the valve's components (e.g., stem or the like). As the cavitation index $\sigma$ continues to drop below the known cavitating value, the quantity of gas that breaks out of the liquid increases.

For these reasons, when the pressures upstream and downstream of the drilling chokes 22 of the MPD system 10 surpass the threshold of the cavitation index a, portion of the cavitating bubbles can travel along the flow path through the Coriolis flowmeter 24 and can cause additional flow measurement error.

In addition to the simple input-output cavitation index discussed above, critical cavitation index is a value that can characterize the effects of local velocity and pressure gradients through a valve, such as the chokes 22. The critical cavitation index can be characterized as:

$$\sigma_i = \frac{(P - p_v)}{\frac{1}{2}\rho V^2}$$

$\sigma_i$ critical cavitation index
P static pressure in undisturbed flow
$p_v$ vapor pressure
$\rho$ liquid density
V free stream velocity of the liquid This formula describes some of the primary physics behind cavitation.

Another cause of gas breakout in MPD operations is due to flash evaporation that can occur within or near the Coriolis flowmeter 24. Flash evaporation results from the pressure drop through a flow restriction where the downstream pressure is below vapor pressure and $\sigma<1$. Cavitation occurs within a range below some critical cavitation number when $\sigma>1$.

Yet another cause of gas breakout in MPD operations can involve flashing that can occur within or near the Coriolis flowmeter 24 when positioned at a higher elevation than the flow exit from the system. Due to the design and layout of some drilling rig operations, for example, there may be difficulty in finding a place for positioning the Coriolis flowmeter 24 at the same elevation or lower than the system's flow exit.

Flashing caused by elevation can be a factor if the drilling mud tank is on the ground level and the flowmeter 24 is located more than 34-ft above the tank. This places around 0-psig at the flowmeter 24 assuming a full, steady stream. Even if the tank is less than 34-ft below the flowmeter 24, the fluid pressure can still drop lower than atmospheric pressure at the flowmeter 24. This makes it easier for small variations, steps, or protrusions within the pipe to cause localized flashing. To prevent flashing issues, manufacturers of Coriolis type flowmeters 24 typically indicate that the system's flow exit should be above the flowmeter 24, which can also keep fluid from draining out of the flowmeter 24 if the flow stops.

In an additional way for gas to enter the flowmeter 24, gas entrained in the fluid can be separated out as the fluid undergoes a pressure drop. For example, entrained gas in oil-based mud can break out during the pressure drop at the choke 22. The gas may not mix back into solution, and the gas bubbles can pass through the flowmeter 24, altering the readings.

One solution to cavitation and gas breakout problems has been to add a valve or orifice downstream of the Coriolis flowmeter 24. In this position, the valve or orifice can reduce the effects of cavitation by adding backpressure within the pipe that extends from the chokes 22 to the flowmeter 24. However, the control valve that has been used is typically controlled manually and is unable to be reliably reset during operations as flow conditions change.

The subject matter of the present disclosure is directed to overcoming, or at least reducing the effects of, one or more of the problems set forth above.

SUMMARY OF THE DISCLOSURE

According to the present disclosure, a drilling system drills a wellbore using one or more valves or chokes to control pressure in drilling fluid flow in a control pressure drilling operation. A measurement of drilling fluid flow from the wellbore is obtained. Based at least in part on the obtained measurement, upstream pressure of the drilling fluid flow in the wellbore is controlled with one or more valves of the drilling system. Based at least in part on the obtained measurement, the drilling fluid flow from the wellbore is selectively distributed through one or more of a plurality of flowmeters of the drilling system. The one or more selected flowmeters can at least periodically obtain the measurement of the drilling fluid flow. For example, the one or more selected flowmeters can obtain a mass flow rate of the drilling fluid flow.

To selectively distribute the drilling fluid flow through the one or more flowmeters, a determination can be made of which of the one or more flowmeters to select for distribution by comparing a measured flow rate, a measured pressure, and the like to a capacity for each of the flowmeters. Additionally, the selective distribution of the drilling fluid flow can seek to minimize an overall measurement error in the measurement obtained using the one or more flowmeters by determining which of the one or more flowmeters to select for distribution based on a comparison of a measurement error for each of the flowmeters.

Controlling the upstream pressure of the drilling fluid flow in the wellbore can occur concurrently with or separately from the selective distribution of the drilling fluid flow through the one or more selected flowmeters. To control the upstream pressure, at least one first valve upstream of at least one of the flowmeters can be operated to adjust the upstream pressure. This can further involve adjusting pressure at least inside the at least one flowmeter using at least one second valve downstream of the at least one flowmeter. In turn, the at least one first valve can be readjusted in response to the adjustment in the upstream pressure caused by the operation of the at least one second valve.

Adjusting the pressure inside the at least one flowmeter using the at least one second valve may be needed when gas breakout is determined to occur in the at least one flowmeter caused by the at least one first valve. The determination can involve comparing one or more operational parameters of the at least one flowmeter to empirical information associated with the at least one flowmeter.

Adjusting the pressure inside the at least one flowmeter using the at least one second valve may be needed based on a cavitation index (calculated based on pressure measured relative to the at least one flowmeter) that differs from an expected valve for the cavitation index (expected from a current position of at least one first valve).

To selectively distribute the drilling fluid flow through one or more of the flowmeters, a first of the flowmeters can be selected based on a first level of the obtained measurement, and a second of the flowmeters and not the first flowmeter can be selected based on a second level of the obtained measurements. For example, the first flowmeter can have a first flow capacity, while the second flowmeter comprises can have a second (greater or lesser) flow capacity. As an alternative, a first of the flowmeters can be selected based on a first level of the obtained measurement, and the first flowmeter as well as a second of the flowmeters can be selected based on a second level of the obtained measurement. The first and second flowmeters can have the same or different capacity.

According to the present disclosure, an apparatus for controlled pressure drilling of a wellbore uses a plurality of flowmeters in parallel fluid communication. A distributor in fluid communication between the wellbore and the plurality of flowmeters is operable to selectively direct drilling fluid flow from the wellbore to one or more of the plurality of flowmeters. The flowmeters each can have a same flow capacity or at least two different flow capacities. Also, the flowmeters can use a same type of flowmeter device or can use at least two different types of flowmeter device. In general, the flowmeters can be a Coriolis flowmeter, a curved tube Coriolis flowmeter, a straight tube Coriolis flowmeter, a V-cone flowmeter, and the like.

The apparatus further includes at least one first valve in fluid communication upstream with the distributor. The at least one first valve is operable to control upstream pressure in the drilling fluid flow. The apparatus can further include at least one second valve in fluid communication downstream with the distributor. The at least one second valve can be operable to control upstream pressure within the one or more flowmeters.

The distributor can have a plurality of first valves each in fluid communication upstream of one of the flowmeters. Each of the first valves can be operable to control upstream pressure in the drilling fluid flow. Alternatively, each of the first valves can be operable (in opened/closed states) to permit and deny the drilling fluid flow through its respective flowmeter. In addition to the first valves, the distributor can have a plurality of second valves each in fluid communication downstream of a respective one of the flowmeters. Each of the second valves can be operable to control upstream pressure in the respective flowmeter.

The apparatus can further include a control in operable communication with the distributor. The control operates the distributor to selectively direct the drilling fluid flow to the one or more flowmeters. The control obtains a measurement of the drilling fluid flow from the wellbore and operates the distributor in accordance with the obtained measurement. The control can be in operable communication with the flowmeters and can control upstream pressure in the drilling fluid flow with one or more valves or chokes of the system based at least in part on a reading from the one or more flowmeters.

According to the present disclosure, drilling a wellbore with a drilling system having one or more valves at least periodically obtains a reading of drilling fluid flow from the wellbore with at least one flowmeter. Upstream pressure in the drilling fluid flow is controlled with at least one first valve based at least in part on the reading from the at least one flowmeter. Cavitation in the drilling fluid flow is estimated through the at least one flowmeter caused by the at least one first valve. Based on the estimated cavitation, pressure of the drilling fluid flow is adjusted within the at least one flowmeter with at least one second valve in downstream communication with the at least one flowmeter.

An apparatus for controlled pressure drilling of drilling fluid flow of a wellbore for performing such an operation can include at least one first valve, at least one flowmeter, at least one second valve, and a control. The at least one first valve is in fluid communication with the drilling fluid flow of the wellbore and is operable with first states to control first upstream pressure of the drilling fluid flow. The at least one flowmeter is in fluid communication downstream of the at least one first valve and is operable to measure the drilling fluid flow past the flowmeters. Finally, the at least one second valve is in fluid communication downstream of the at least one flowmeter and is operable with second states to control second upstream pressure of the drilling fluid flow at least in the at least one flowmeter. In this apparatus, the control is in operable communication with the at least one second valve and automatically adjusts the second state of the at least one second valve based on a cavitation value associated with the first state of the at least one first valve.

According to the present disclosure, drilling a wellbore with a drilling system having one or more valves at least periodically obtains a first reading of drilling fluid flow from the wellbore with a first flowmeter and at least periodically obtains at least one second reading of drilling fluid flow from the wellbore with at least one second flowmeter in series communication with the first flowmeter. The first and at least one second readings are compared with one another. Upstream pressure in the drilling fluid flow is then controlled with at least one valve based at least in part on the comparison.

An apparatus for controlled pressure drilling of drilling fluid flow of a wellbore for performing such an operation can include at least one first valve, a first flowmeter, at least one second flowmeter, and a control. The at least one first valve is in fluid communication with the drilling fluid flow of the wellbore and is operable with first states to control first upstream pressure of the drilling fluid flow. The first flowmeter is in fluid communication downstream of the at least one first valve and is operable to measure a first reading of the drilling fluid flow therepast. The at least one second flowmeter is in series communication downstream of the first flowmeter and is operable to measure at least one second reading of the drilling fluid flow therepast. The control is in operable communication with the first and at least one second flowmeters and compares the first and at least one second readings. The control controls the first states of the at least one first valve based at least in part on the comparison.

The foregoing summary is not intended to summarize each potential embodiment or every aspect of the present disclosure.

DETAILED DESCRIPTION OF THE DISCLOSURE

A. System Overview

Figure 2:
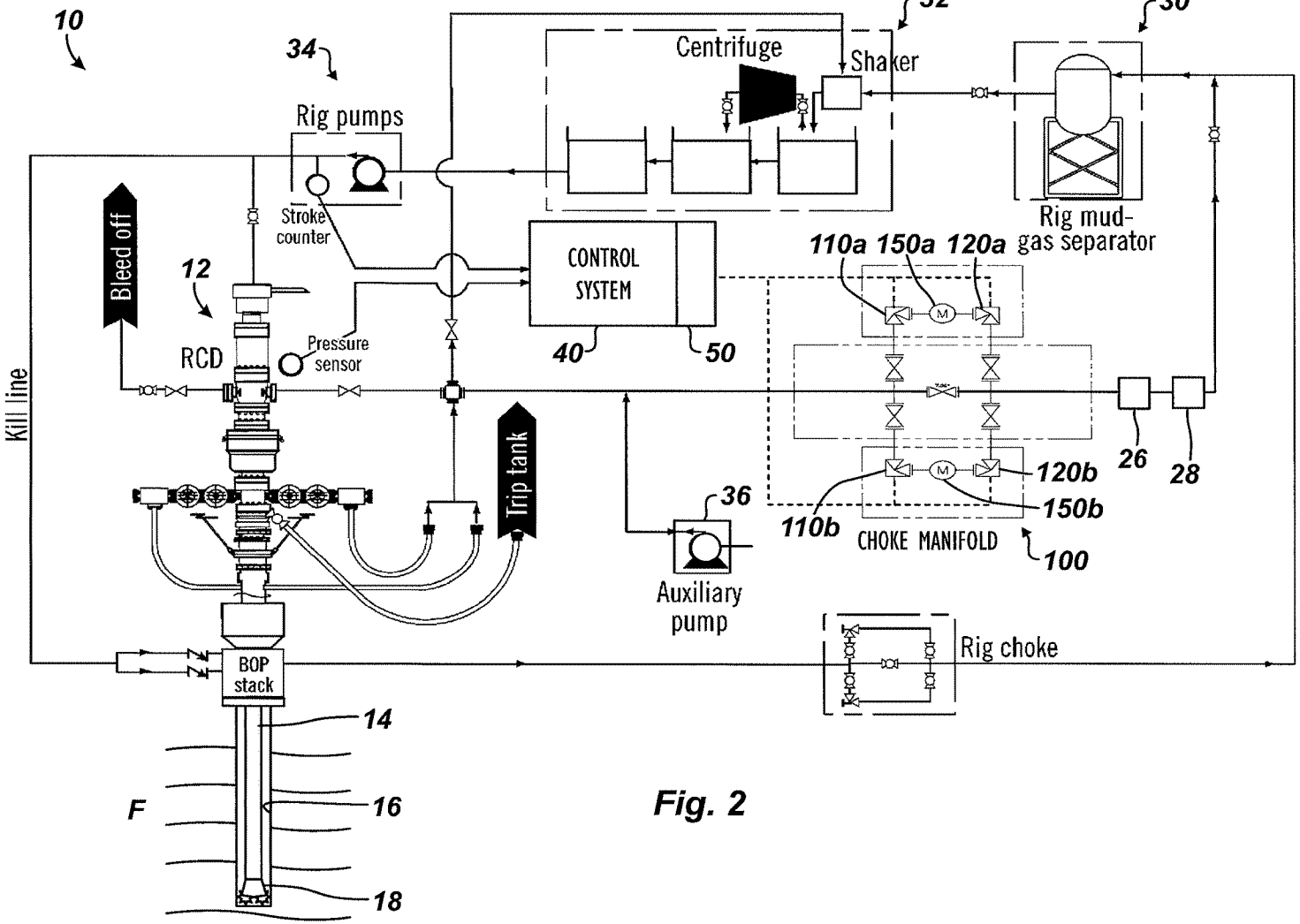
FIG. 2 illustrates a controlled pressure drilling system having a choke manifold and a distribution of flowmeters according to the present disclosure.

FIG. 2 shows a closed-loop drilling system 10 according to the present disclosure for controlled pressure drilling. As shown and discussed herein, this system 10 can be a Managed Pressure Drilling (MPD) system and, more particularly, a Constant Bottomhole Pressure (CBHP) form of MPD system. Although discussed in this context, the teachings of the present disclosure can apply equally to other types of controlled pressure drilling systems, such as other MPD systems (Pressurized Mud-Cap Drilling, Returns-Flow-Control Drilling, Dual Gradient Drilling, etc.) as well as to Underbalanced Drilling (UBD) systems, as will be appreciated by one skilled in the art having the benefit of the present disclosure.

Figure 1:
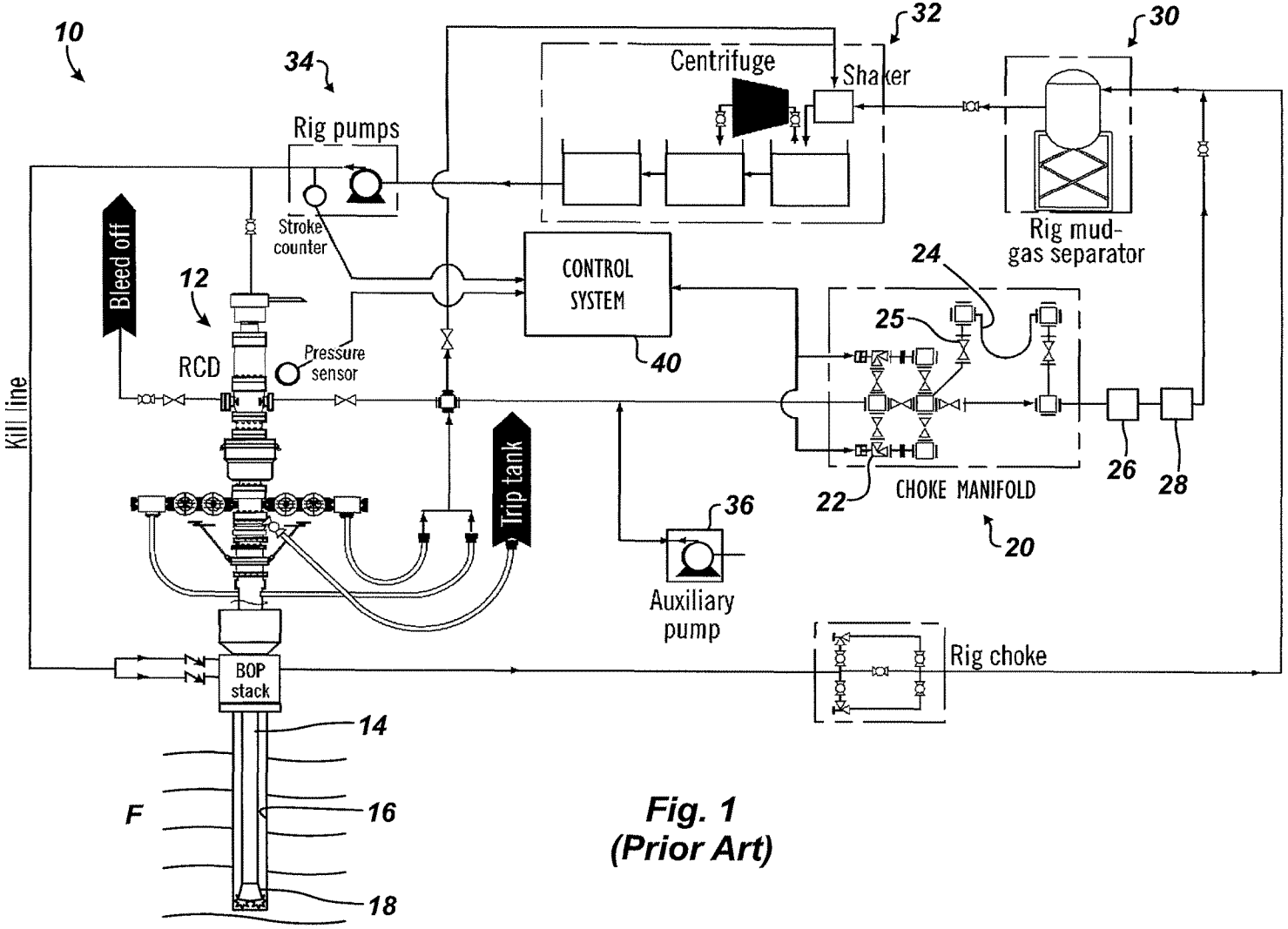
Fig. 1 (Prior Art)
FIG. 1 illustrates a controlled pressure drilling system having a choke manifold and a flowmeter according to the prior art.

The drilling system 10 of FIG. 2 has a number of similarities to the system already discussed in FIG. 1. For instance, the drilling system 10 has a rotating control device (RCD) 12 from which a drill string 14, a bottom hole assembly (BHA), and a drill bit 18 extend downhole in a wellbore 16 through a formation F. The rotating control device 12 can include any suitable pressure containment device that keeps the wellbore in a closed-loop at all times while the wellbore 16 is being drilled. The system 10 also includes mud pumps 34, a standpipe (not shown), a mud tank 32, a mud gas separator 30, and various flow lines, as well as other conventional components.

In addition to these, the drilling system 10 includes an automated choke manifold 100 that is incorporated into the other components of the system 10. As explained in more detail below, the choke manifold 100 is different from the conventional manifold of the prior art. In one implementation for managed pressure drilling where mass flow measurements and flow control valves (i.e., chokes) are both used to control wellbore fluids while drilling a well, the manifold 100 of the present disclosure has multiple (two or more) mass flowmeters 150*a-b* connected in a parallel arrangement.

Briefly, the manifold 100 has main chokes 110*a-b* and multiple mass flow meters 150*a-b*. In addition to these, the manifold 100 can have some conventional components, such as pressure sensors (not shown), local control electronics (not shown) to control operation of the manifold 100, and a hydraulic power unit (not shown) and/or electric motor to actuate the chokes 110*a-b*.

A drilling choke 110*a-b* can be connected in front of each flowmeter 150*a-b* and can be used in conjunction with feedback of flow rates and other parameters to control when fluid will enter the respective flowmeter 150*a-b*. The combined assembly of all the drilling chokes 110*a-b* and mass flowmeters 150*a-b* connected in parallel can then be concurrently used to control the wellbore pressure and flow while drilling according to the manage pressure drilling operations.

This assembly lends itself to a more compact form of MPD manifold 100. For example, the chokes 110*a-b*, flowmeters 150*a-b*, and the like can be stacked or placed in rows within close proximity to each other. Alternatively, each series of choke 110*a-b*, flowmeter 150*a-b*, and the like can be assembled remotely wherever space is available on a rig floor, but can be connected in parallel using piping and valves.

Keeping the gas in solution for the flowmeters 150*a-b* after the chokes 110*a-b* can be at least partially controlled by adding flow control valves (i.e., chokes 120*a-b*), orifices, or the like down-stream of the flowmeters 150*a-b*. Preferably, the chokes 120*a-b* are controllable based on operating conditions. As described in more detail later, the downstream chokes 120*a-b* can supply adequate backpressure to the flowmeters 150*a-b*, thereby keeping the gas in solution and allowing the flowmeters 150*a-b* to read the fluid flow rate with improved accuracy even during operational changes. With respect to elevation, the secondary chokes 120*a-b* can allow the flowmeter(s) 150*a-b* to have a higher elevation than the flow exit of the system 10, which could otherwise cause problems in other situations.

Finally, a control system 40 of the drilling system 10 is centralized and integrates hardware, software, and applications across the drilling system 10. The centralized control system 40 is used for monitoring, measuring, and controlling parameters in the drilling system 10. As such, the control system 40 can be characterized as a managed pressure drilling (MPD) control system. In this contained environment of closed-loop drilling, for example, the MPD control system 40 can analyze pressure and flow data to detect kicks, losses, and other events, and the system 40 can manage pressure and flow during drilling using the automated choke manifold 100.

However, contrary to the conventional system of the prior art, the MPD control system 40 of the present disclosure has a manifold controller 50 with a number of control features for the particular choke manifold 100, as will be discussed in more detail below. This manifold controller 50 can be part of, integrated into, or communicatively coupled to the components of the MPD control system 40. In fact, the controller 50 and system 40 may share many of the same resources, measurements, hardware, communications, and the like.

Briefly, the system 10 in operation uses the rotating control device 12 to keep the well closed to atmospheric conditions. Fluid leaving the wellbore 16 flows through the automated choke manifold 100, which measures return flow and density using the flowmeter(s) 150*a-b* installed in line with the chokes 110*a-b*. Software components of the MPD control system 40 then compare the flow rate in and out of the wellbore 16, the injection pressure (or standpipe pressure), the surface backpressure (measured upstream from the drilling chokes 110*a-b*), the position of the chokes 110*a-b*, and the mud density. Comparing these variables, the MPD control system 40 identifies minute downhole influxes and losses on a real-time basis to manage the annulus pressure during drilling.

During drilling, the manifold's flowmeters 150*a-b* can measure volume flow rates and density of the drilling fluid. For example, in managed pressure drilling (MPD), fluid flow is measured using the flowmeters 150*a-b* to determine lost circulation, to detect fluid influxes or kicks, to measure mud density, to monitor fluid returns, etc.

In the controlled pressure drilling, the MPD control system 40 introduces pressure and flow changes to this incompressible circuit of fluid at the surface to change the annular pressure profile in the wellbore 16. In particular, using the manifold controller 50 and the choke manifold 100 to apply surface backpressure within the closed loop, the MPD control system 40 can produce a reciprocal change in bottomhole pressure. In this way, the MPD control system 40 uses real-time flow and pressure data and manipulates the annular backpressure to manage wellbore influxes and losses.

In operation, the MPD control system 40 uses internal algorithms to identify what is occurring downhole and reacts automatically. As can be seen, the MPD control system 40 monitors for any deviations in values during drilling operations, and alerts the operators of any problems that might be caused by a fluid influx into the wellbore 16 from the formation F or a loss of drilling mud into the formation F. In addition, the MPD control system 40 can automatically detect, control, and circulate out such influxes by operating the chokes 110*a-b* on the choke manifold 100.

For example, a possible fluid influx or "kick" can be noted when the "flow out" value (measured from the flowmeter(s) 150*a-b*) deviates from the "flow in" value (measured from the stroke counters of the mud pumps 34 or elsewhere). As is known, a "kick" is the entry of formation fluid into the wellbore 16 during drilling operations. The kick occurs because the pressure exerted by the column of drilling fluid is not great enough to overcome the pressure exerted by the fluids in the formation F being drilled.

The kick or influx is detected when the well's flow-out is significantly greater than the flow-in for a specified period of time. Additionally, the standpipe pressure (SPP) should not increase beyond a defined maximum allowable SPP increase, and the density-out of fluid out of the well does not drop more than a surface gas density threshold. When an influx or kick is detected, an alert notifies the operator to apply the brake until it is confirmed safe to drill. Meanwhile, no change in the rate of the mud pumps 34 is needed at this stage.

In the MPD control system 40, the kick control can be an automated function that combines kick detection and control, and the MPD control system 40 can base its kick control algorithm on the modified drillers' method to manage kicks. In a form of auto kick control, for example, the MPD control system 40 automatically closes the choke(s) 110*a-b* to increase surface backpressure in the wellbore annulus 16 until mass balance is established and the influx stops.

The MPD control system 40 adds a predefined amount of pressure as a buffer and circulates the influx out of the well by controlling the standpipe pressure. The standpipe pressure will be maintained constant by automatically adjusting the surface backpressure, thereby increasing the downhole circulating pressure and avoiding a secondary influx. This can all be monitored and displayed on the MPD control system 40 to offer additional control of these steps.

Once the flow-out and flow-in difference is brought under control, the control system 40 will maintain this equilibrium for a specified time before switching to the next mode. In a successful operation, the kick detection and control cycle can be expected to be managed in roughly two minutes. The kick fluid will be moving up in the annulus with full pump speed using a small decreased relative flow rate of about −0.1 gallons per minute to safely bring the formation pressure to balance.

As opposed to an influx, a possible fluid loss can be noted when the "flow in" value (measured from the stroke counters of the pumps 34 or elsewhere) is greater than the "flow out" value (measured by the flowmeter(s) 150*a-b*). As is known, fluid loss is the loss of whole drilling fluid, slurry, or treatment fluid containing solid particles into the formation matrix. The resulting buildup of solid material or filter cake may be undesirable, as may be any penetration of filtrate through the formation, in addition to the sudden loss of hydrostatic pressure due to rapid loss of fluid. In the closed-loop drilling system 10, any observed loss can only be attributed to the formation F.

Similar steps as those above, but suited for fluid loss, can then be implemented by the MPD control system 40 to manage the pressure and flow during drilling in this situation. Killing the well is attempting to stop the well from flowing or having the ability to flow into the wellbore 16. Kill procedures typically involve circulating reservoir fluids out of the wellbore or pumping higher density mud into the wellbore 16, or both.

The operator can initiate pumping the new mud with the recommended or selected kill mud weight. As the kill mud starts to go down the wellbore 16, the chokes 110*a-b* are opened up gradually approaching a snap position as the kill mud circulates back up to the surface. Once the kill mud turns the bit 18, the MPD control system 40 again switches back to standpipe pressure (SPP) control until the kill mud circulates all the way back up to the surface.

In addition to the choke manifold 100, the drilling system 10 can include a continuous flow system (not shown), a gas evaluation device 26, a multi-phase flowmeter 28, and other components incorporated into the system 10. The continuous flow system allows flow to be maintained while drill pipe connections are being made, and the drilling system 10 may or may not include such components. For its part, the gas evaluation device 26 can be used for evaluating fluids in the drilling mud, such as evaluating hydrocarbons (e.g., C1 to C10 or higher), non-hydrocarbon gases, carbon dioxide, nitrogen, aromatic hydrocarbons (e.g., benzene, toluene, ethyl benzene and xylene), or other gases or fluids of interest in drilling fluid. Accordingly, the device 26 can include a gas extraction device that uses a semi-permeable membrane to extract gas from the drilling mud for analysis.

The multi-phase flowmeter 28 can be installed in the flow line to assist in determining the make-up of the fluid. As will be appreciated, the multi-phase flowmeter 28 can help model the flow in the drilling mud and provide quantitative results to refine the calculation of the gas concentration in the drilling mud.

B. Manifold Arrangements

As shown in FIG. 2, the manifold 100 includes multiple flowmeters 150*a-b* connected in a parallel arrangement. The various flowmeters 150*a-b* can be of similar size, or a combination of sizes connected in parallel. In both cases, the manifold 100 with the parallel flowmeters 150*a-b* preferably maintains an equivalent maximum flow measuring capacity of an original design requirement associated with a conventional, single flowmeter.

FIGS. 3 through 6 illustrate different schematics for choke manifolds 100 having multiple flowmeters 150 in parallel according to the present disclosure. In each of these arrangements, a distribution of valves and/or chokes 101, 102, 104, 105, 110, 120 direct flow through certain combinations of the flowmeters 150.

Figure 3:
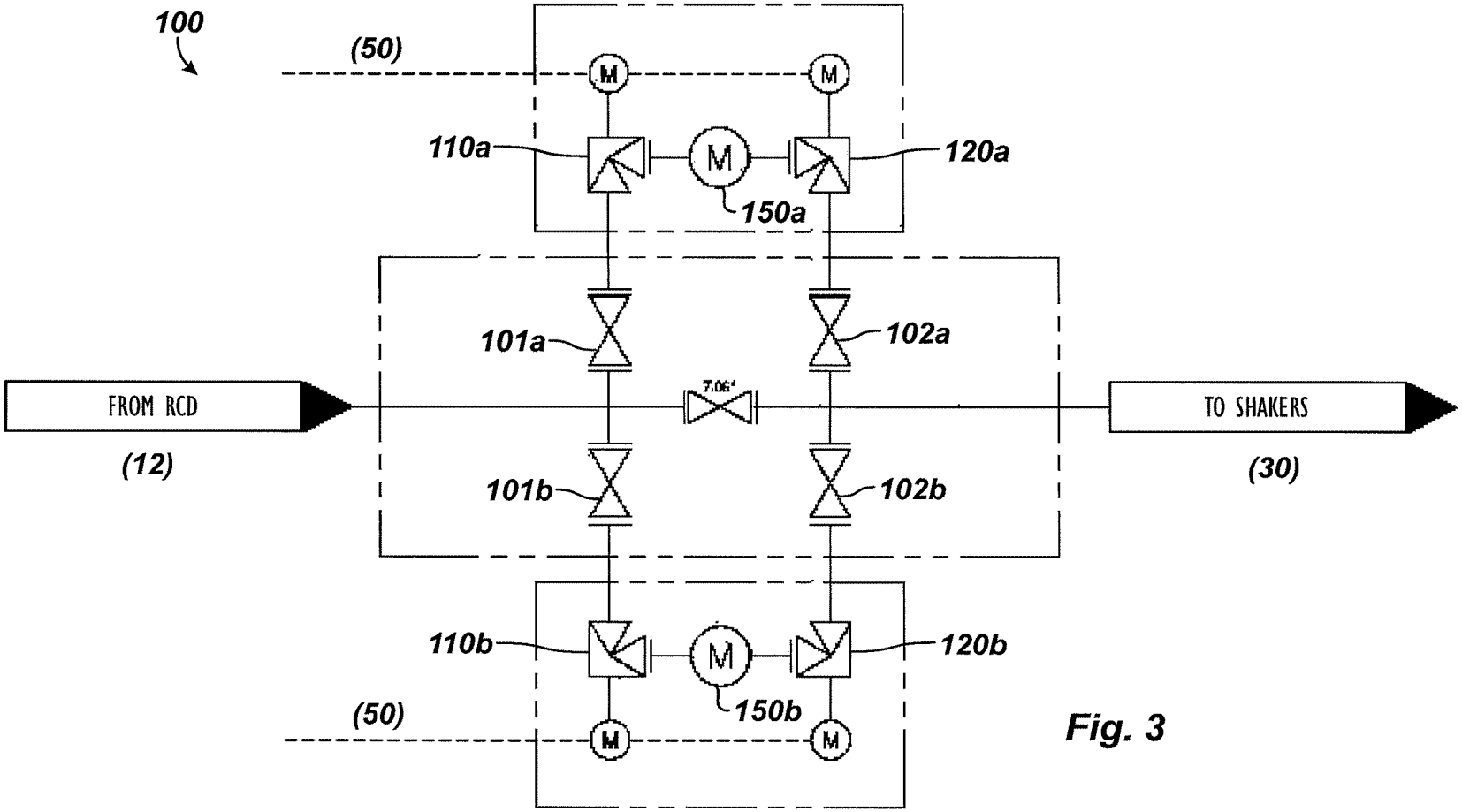
FIGS. 3-6 illustrate different schematics for choke manifolds having multiple flowmeters in parallel according to the present disclosure.

As shown in FIG. 3, drilling fluid flow from the RCD (12) is directed to the manifold 100, which includes two main chokes 110*a-b* and two flowmeters 150*a-b*. Branching through separate distribution valves 101*a-b*, the drilling fluid flow at the inlet of the manifold 100 can pass to the two main chokes 110*a-b*, which are separately operable. Both of the main chokes 110*a-b* can control the backpressure in the wellbore upstream of the manifold 100. The various distribution valves 101, 102, 104, 105 can be manually operated. Alternatively, similar to the chokes 110, 120, the various distribution valves 101, 102, 104, 105 can be automatically operated.

At the same time, both chokes 110*a-b* can selectively direct flow through its respective flowmeter 150*a-b*. For example, the first flowmeter 150*a* may have a first flow capacity, while the second flowmeter 150*b* may have a second flow capacity—different from or the same as the first flow capacity. By opening the first choke 110*a* and closing the second choke 110*b*, flow through the manifold 100 can be configured for the first flow capacity. By opening the second choke 110*b* and closing the first choke 110*a*, flow through the manifold 100 can be configured for the second flow capacity. Finally, by opening both of the chokes 110*a-b*, flow through the manifold 100 can be configured for at least the greatest flow capacity.

In one configuration, each flowmeter 150*a-b* in the manifold 100 can be of reduced size compared with an equivalent system that implements only one flowmeter. The smaller flowmeters 150*a-b* can inherently obtain more accurate flow measurements at low flow rates compared to a single larger flowmeter. In this configuration, the use of smaller flowmeters 150*a-b* and smaller piping leading up to them in the manifold 100 can lead to a straightening effect of the pipe on the flow of fluid. Flow that moves through a smaller pipe diameter can be straightened and conditioned for the entry of the flowmeter 150*a-b* within a shorter distance of pipe length. This can provide an extra benefit that reduces the geometry of the manifold 100.

In any of the arrangements for the manifold 100 in FIG. 3, flow from the flowmeters 150*a-b* can pass through secondary chokes 120*a-b* before branching back through distribution valves 102*a-b* to the outlet of the manifold 100 and on to the shakers (30) or other components of the drilling system. These secondary chokes 120*a-b* may not be strictly operable to control the backpressure of the drilling fluid flow to perform well control operations, although they can at least be operable to do this at least to some degree. Instead, these secondary chokes 120*a-b* may be operable to control upstream pressure within its respective flowmeter 150*a-b*, which can have a number of uses as disclosed herein.

Figure 4:
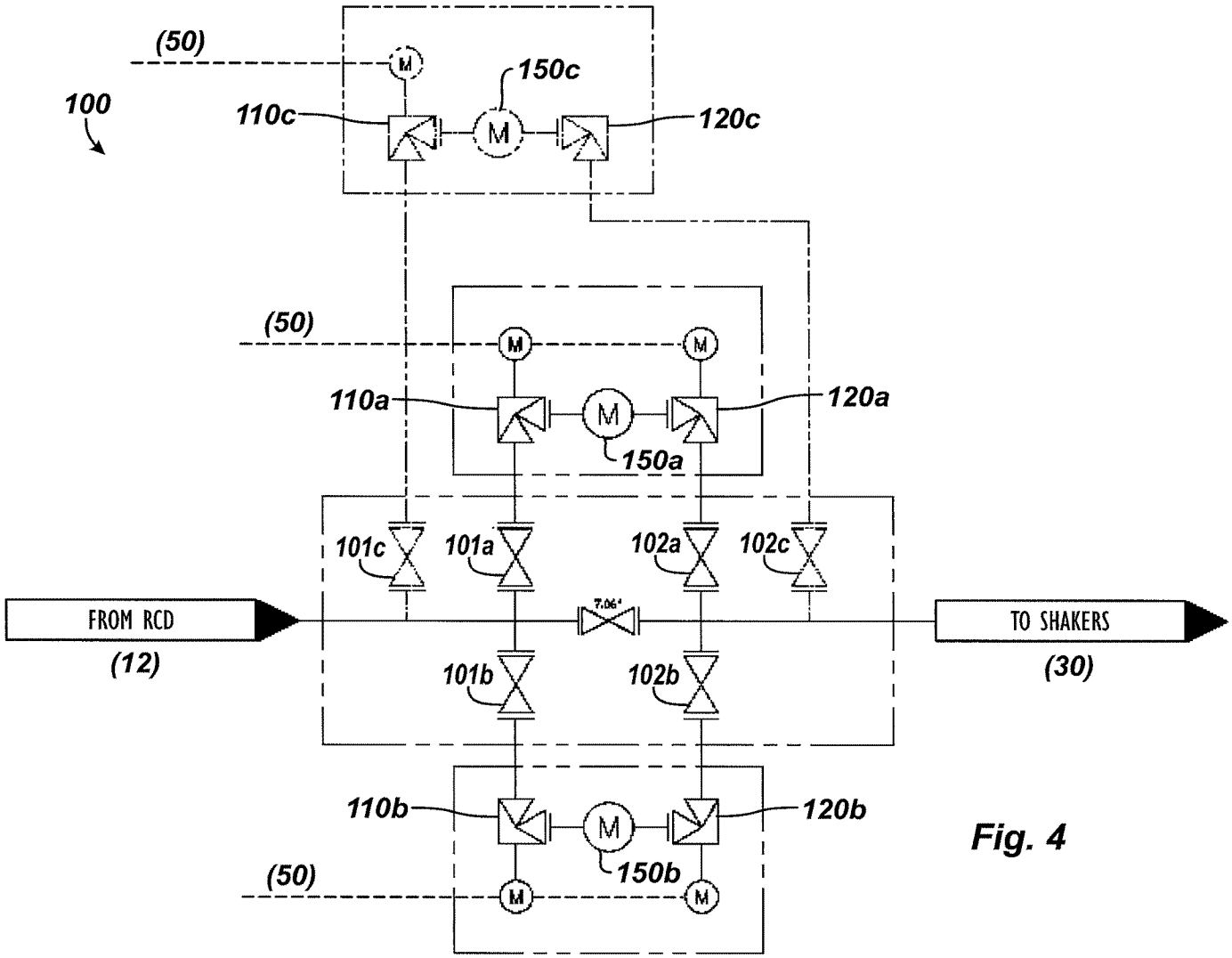

As shown in FIG. 4, the arrangement of two main chokes 110*a-b* and two flowmeters 150*a-b* of FIG. 3 is shown expanded to include a third parallel leg with a main choke 110*c* and a flowmeter 150*c*. This third leg provides a third path for controlling backpressure using the choke 110*c* and for measuring flow using a third flow capacity of the third flowmeter 150*c*. Again, this third leg may have a secondary choke 120*c* to control the pressure in the third flowmeter 150*c*.

In one arrangement, each of the flowmeters 150*a-c* of the manifold 100 in FIG. 4 can have the same flow capacity, and the legs can be used as separate, multiple routes for the fluid flow. In this case, the manifold 100 includes a primary leg having an upstream choke 110*a*, a flowmeter 150*a*, and a downstream choke 120*a* connected directly in series. A need may arise to isolate the this primary leg, such as a sudden plugging of the flowmeter 150*a* or one of the chokes 110*a*, 120*a*; a need for service or repair of the flowmeter 150*a* or chokes 110*a*, 120*a*; or some other reason.

When such a need or reason arises, the primary leg can be isolated with the externally connected distribution valves 101*a*, 102*a*. Flow can be re-routed through the second and/or third legs connected in parallel. Isolation of the whole control leg is achieved more quickly with the closing of two external valves rather than the closing of several internal valves that a typical MPD system might employ. As can be seen, the use of multiple flowmeters 150*a-c* can increase the dependability of the manifold 100 by implementing redundant flowmeter legs in parallel. If one flowmeter 150*a-c* is plugged by debris, the flow can pass through the other open flowmeter(s) 150*a-c*.

In another arrangement, two or more flowmeters 150*a-b* and/or chokes 110*a-b* can be arranged so that one flowmeter 150 and/or choke 110 is the primary system or flow path. If the primary system needs to be serviced, a secondary flowmeter 150 and/or flowmeter choke set (110, 150) can be used without having to shut down the drilling operation. Further, if there are primary, secondary, and tertiary legs, and the primary and secondary legs can be adequately sized for the normal drilling operations. The tertiary leg may then only be used as a backup system. If either the primary or secondary flowmeter 150*a-b* needs to be isolated and taken out of for service, the tertiary leg may be activated without having to disrupt the drilling operation.

As an alternative to having flowmeters 150*a-c* of the same flow capacity, one or more of the three flowmeters 150*a-c* can have different flow capacities, allowing for selective distribution of the fluid flow based on capacities as disclosed herein. For example, two of the flowmeters 150*a-b* may have conventional flow capacities of several thousand gallons per minute (e.g., 3000 GPM) with appropriate accuracy and low measurement error at the higher flow rates. However, the third flowmeter 150*c* may be rated for better measurement at significantly lower flow rates (e.g., less than 100 GPM, 20 to 50-GPM, etc.).

With this arrangement, the two main flowmeters 150*a-b* can be used for most operations of the manifold 100, such as the managed pressure drilling operations. When moments of low flow occur during operations, however, the manifold 100 can switch its use exclusively to the third, smaller flowmeter 150*c* so that accurate measurements with lower error can still be obtained during operations. As one example, low flow may occur during tubing connections, reduced pump rates, tripping, drilling forward, or other operations that may have reduced flow. In these situations, the third flowmeter 150*c* can be operated alone instead of the larger flowmeters 150*a-b*. This can allow various flow parameters and conditions to be monitored during these operations in ways not possible with a conventional manifold having a one-size flowmeter with its higher measurement errors at low flow rates.

Notably, the measurement accuracy of a given flowmeter 150*a-c* can be quite reliable for most of the flow range in which it is to be used. At lower levels of the flow range, the measurement error of the flowmeter typically increases sharply. This makes a given flowmeter 150*a-c* less suited for use in measuring lower levels of its flow range since the error becomes too large. As will be understood, measurement accuracy can depend on the type of fluid, the flow conditions, temperatures, etc. In general terms though, the measurement accuracy of a given flowmeter 150*a-c* can be quite reliable for most (e.g., about 95%) of the flow range, and error may increase sharply at lower levels (e.g., at about 5%) of the flow range.

In instances of low flow, the manifold controller (50) preferably switches to use of the third flowmeter 150*c* exclusively when a lower flow threshold is expected or occurs during operations. The control system 100 can switch when the flow rate is expected to drop below a threshold in an expected time interval after the occurrence of some operation, such as dropping of a known pump rate in the system 10. Thus, the switching can be proactively controlled by the manifold controller (50) based on current operations. Additionally, the switching can be based on currently monitored conditions and can use feedback from the currently used one or more flowmeters 150*a-c* to determine if a given threshold has been reached warranting switching to another one or more of the flowmeters 150*a-c*.

By switching to the third flowmeter 150*c*, for example, the manifold controller (50) can monitor low flow rates during certain operations and can control operations in a more continuous manner and in ways not currently available. For example, the flow out of the wellbore can be monitored during pipe connections as the low flow rate passes exclusively through the third flowmeter 150*c*. In current arrangements, such measurements would not be obtained or would contain a very high degree of uncertainty.

In addition, current arrangements may rely entirely on the use of an auxiliary pump (36; FIG. 1) as a way to provide minimum flow through a single flowmeter (24: FIG. 1). For example, the auxiliary pump (36) may keep a minimum flow of 100-GPM through the single, conventional flowmeter (24) so it can continue to obtain readings. The present arrangement using the third flowmeter 150*c* exclusively for lower flow rates, however, relies less on the use of such an auxiliary pump (36: FIG. 2) of the disclosed system (10) and suffers less from the complications that using the auxiliary pump (36) can present during operations and measurements.

As an alternative to two common capacities and a third different capacity, the multiple flowmeters 150*a-c* of the manifold 100 in FIG. 4 can each have a different capacity and can be used one at a time while measuring the varying flow rates of fluid. The smallest flowmeter (e.g., 150*c*) can take measurements for the smallest threshold, the largest flowmeter (e.g., 150*a*) can measure the largest threshold of flow, and any intermediate flowmeter (e.g., 150*b*) can measure the intermediate thresholds. Again, a system of valves 101, 102, 110, etc. can direct the flow through each flowmeter 150*a-c* with a feedback control loop.

Figure 5:
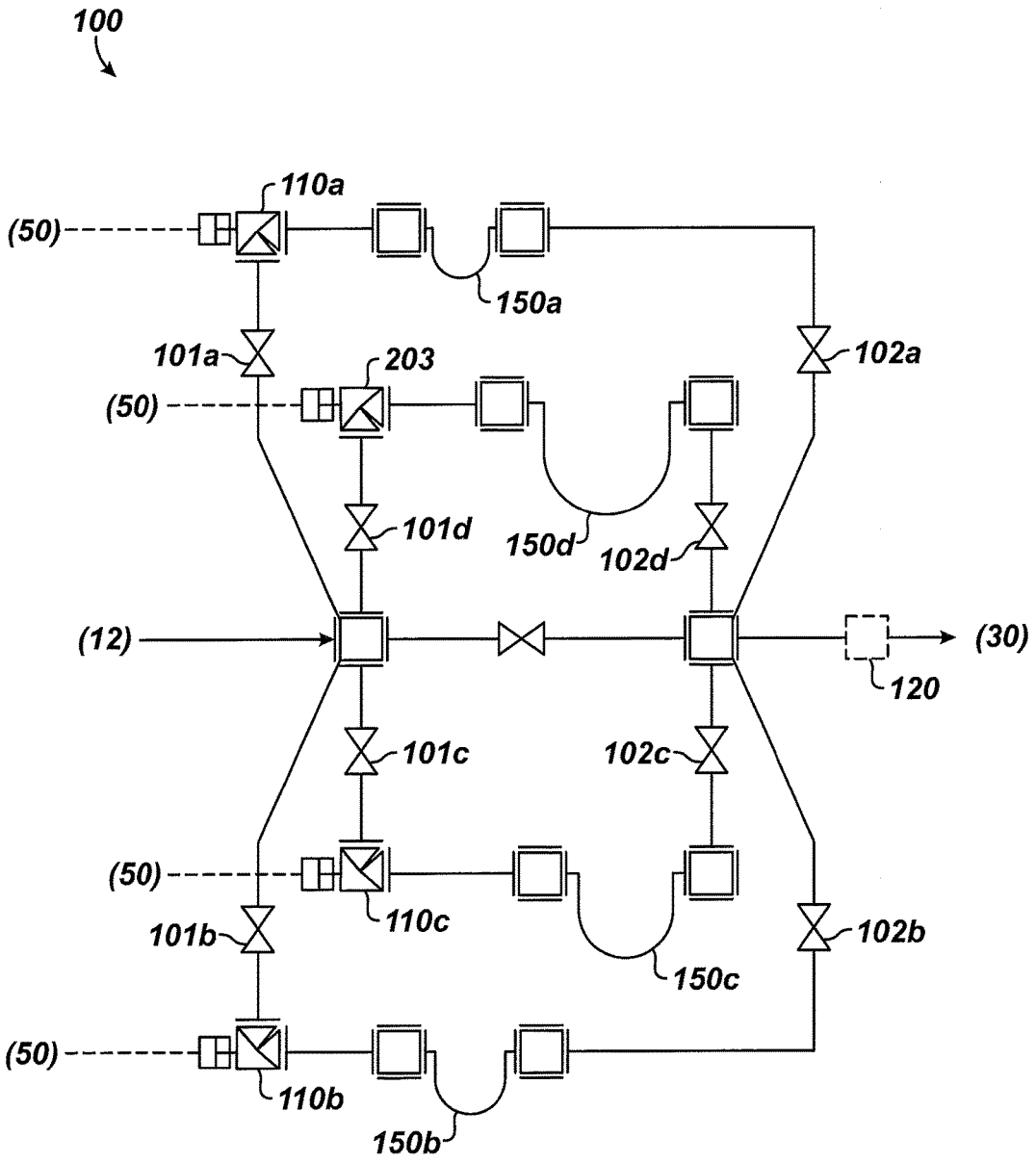
Figure 6:
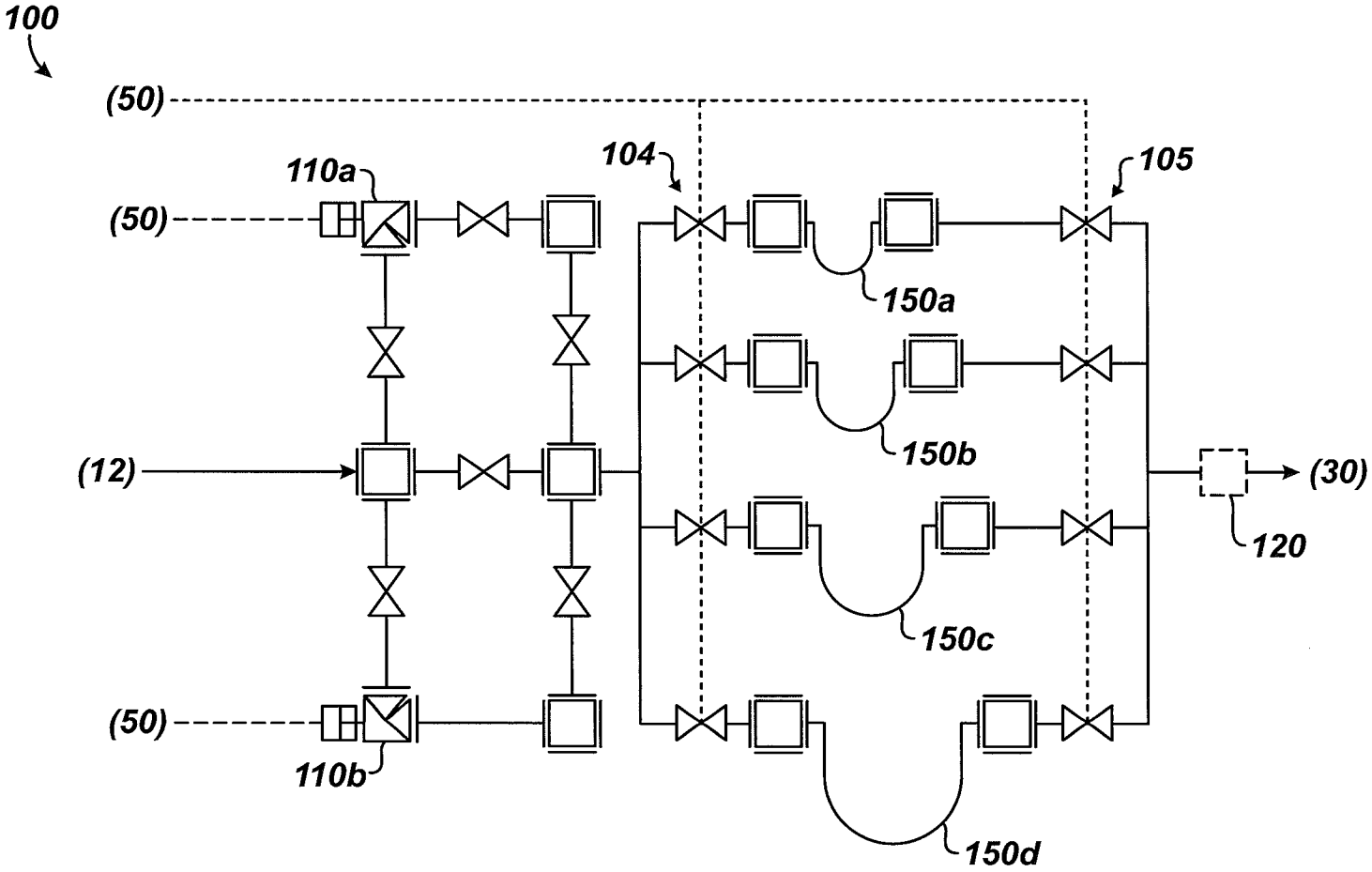

Another manifold 100 shown in FIG. 5 includes four legs of main chokes 110*a-d* and flowmeters 150*a-d*. These four legs provide four paths for controlling backpressure with the chokes 110*a-d* and for measuring flow with four flow capacities of the four flowmeters 150*a-d*. Again, although not shown in this particular example, each of these legs may have a secondary choke (120) to control the pressure in the respective flowmeter 150*a-d*. Alternatively as depicted here, a single secondary choke (120) can be positioned on the common outlet of the four legs to control the pressure in all of the flowmeters 150*a-d* through which flow passes.

As already noted above, the flow capacities of the various flowmeters 150*a-d* in the manifold 100 can be the same or different from one another. In fact, the flowmeters 150*a-d* are illustrated in the configuration of FIG. 5 as an example of having different capacities.

In the previous arrangements, each leg of parallel flowmeters 150 have included a respective upstream choke 110. This is not strictly necessary. Instead, an external system of valves 101, 102, 104, 105, etc. can be implemented to isolate/select the different flow paths for the flowmeters 150 after one or more shared upstream chokes 110. As shown in the manifold 100 of FIG. 6, for example, one or more shared upstream chokes 110*a-b* can receive the drilling fluid flow from the RCD 12 and can be disposed uphole of parallel flowmeters 150*a-d*. The chokes 110*a-b* control the backpressure of the drilling fluid flow in a similar manner to a conventional choke manifold. The implementation of one or more shared chokes 110*a-b* positioned upstream of a stack of several flowmeters 150*a-d* in parallel can optimize flow routing and can more readily be integrated with MPD choke controls of an MPD control system (40).

To selectively distribute the drilling fluid flow to one or more of the parallel flowmeters 150*a-d*, the arrangement has legs with valves 104 for each of the respective flowmeters 150*a-d*. Although preferably controllable, these valves 104 may not necessarily operate as chokes to the flow and may be operated in primary open or closed states to either permit or deny fluid flow through the respective flowmeter 150*a-d*. Secondary valves 105 can be similarly opened/closed to prevent reverse flow from another leg. These secondary valves 105 can be chokes to control the pressure in the respective flowmeter 150*a-d* if this form of control is desired, or a common downstream choke 120 as depicted can be provided at the outlet of the manifold 100. The various valves 104, 105 can be controllable valves directed by the controller 50.

The distribution arrangements of chokes 110, flowmeters 150, downstream chokes 120, valves 104 or 105, etc. disclosed above with reference to FIGS. 2-6 represent some of several configurations for the disclosed manifold 100. Based on the teachings of the present disclosure, it will be appreciated that these and other arrangements can be used including more or less legs of chokes 110/120; flowmeters 150; valves 101, 102, 104, 105, 120; sizes; flow capacities, etc.

C. Controller

Figure 7:
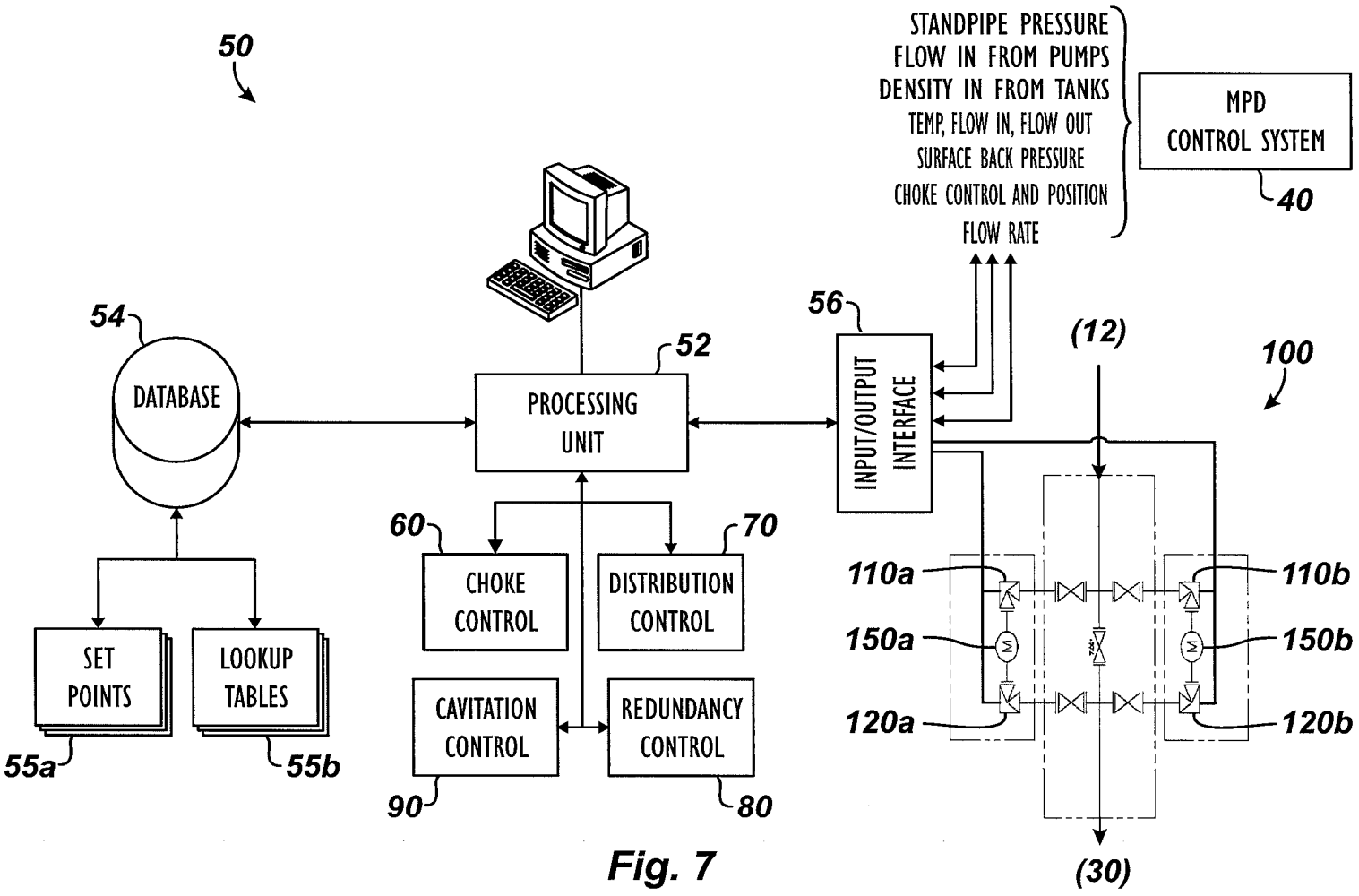
FIG. 7 illustrates a schematic of the disclosed control system.

In each of these distribution arrangements, the manifold controller (50: FIG. 2) controls the manifold 100 of main chokes 110, flowmeters 150, secondary chokes 120, valves, etc. using a feedback control loop based on mass flow rate and pressure. As an example, FIG. 7 schematically illustrates a manifold controller 50 for the manifold 100. As depicted, the manifold controller 50 can be part of, integrated with, or interface with the MPD control system 40 for the drilling operations. The controller 50 includes a processing unit 52, which can be part of a computer system, a server, a programmable logic controller, etc. Using input/output interfaces 56, the processing unit 52 can communicate with the chokes 110, 120; valves 101, 102, 104, 105; sensors (not shown); flowmeters 150; and other system and manifold components to obtain and send communication, sensor, actuator, and control signals for the various components as the case may be. In terms of the current controls discussed, the signals can include, but are not limited to, choke position signals, pressure signals, flow signals, temperature signals, fluid density signals, etc.

The processing unit 52 also communicatively couples to a database or storage 54 having set points 55*a*, lookup tables 55*b*, and other stored information. The lookup tables 55*b* can characterize the specifications of the chokes 110, 120 and the flow character for the flowmeters 150 and the manifold 100. This information can define the flow capacities, pressure limits, measurement errors, etc. of the manifold's flowmeters 150 and can define the flow coefficient, cavitation index, and other details of the manifold's chokes 110, 120 and valves. Although lookup tables 55*b* can be used, it will be appreciated that any other form of curve, function, data set, etc. can be used to store the information. Additionally, multiple lookup tables 55*b* or the like can be stored and can be characterized based on different chokes, different drilling fluids, different operating conditions, and other scenarios and arrangements.

The processing unit 52 operates a choke control 60 for MPD operations. Additionally, the processing unit 52 can operate one or more of a distribution control 70, a redundancy control 80, and a cavitation control 90, depending on the configuration of the manifold 100 according to the present disclosure.

The choke control 60 is used for controlling the main chokes 110 of the manifold 100 to change the surface backpressure upstream of the manifold 100. Main details of the choke control 60 are used in MPD operations and are not discussed here, although some pertinent details have already been discussed. In general, for example, the choke control 60 can maintain pressures within operating limits during MPD operations, change backpressure in response to kicks, perform well control steps, etc. in conjunction with the MPD control system 40, various measurements, algorithms, and the like. As such, the choke control 60 transmits signals to one or more of the main chokes 110 of the manifold 100 using any suitable communication to control their operation. In general, the signals are indicative of a choke position or position adjustment to be applied to the chokes 110. Typically, the main chokes 110 are controlled by hydraulic power so that electronic signals transmitted by the processing unit 52 may operate solenoids, valves, or the like of a hydraulic power unit for operating the chokes 110.

As noted herein, two or more main chokes 110*a-b* can be used in the manifold 100. The same choke control signals can apply adjustments to each of the chokes 110*a-b* during some forms of operation, or separate choke control signals can be used for each main choke 110*a-b* during other forms of operation. In fact, the main chokes 110*a-b* may have differences that can be accounted for in the various choke control signals used.

In addition to the choke control 60, the processing unit 52 can operate the selective distribution control 70 for controlling the main chokes 110; secondary chokes 120; and/or other valves 101, 102, 104, 105 to select which of the multiple flowmeters 150 to distribute flow to for metering. This selective distribution control 70 can minimize measurement errors associated with the multiple flowmeters 150. As further discussed herein, the selective distribution control 70 can operate with the choke control 60 and the main chokes 110 to not only distribute flow to the flowmeters 150, but also control backpressure for the MPD control system 40. In addition to what has already been discussed with reference to FIGS. 2-6, details of the selective distribution control 70 are provided with reference to FIG. 8.

Figure 9A:
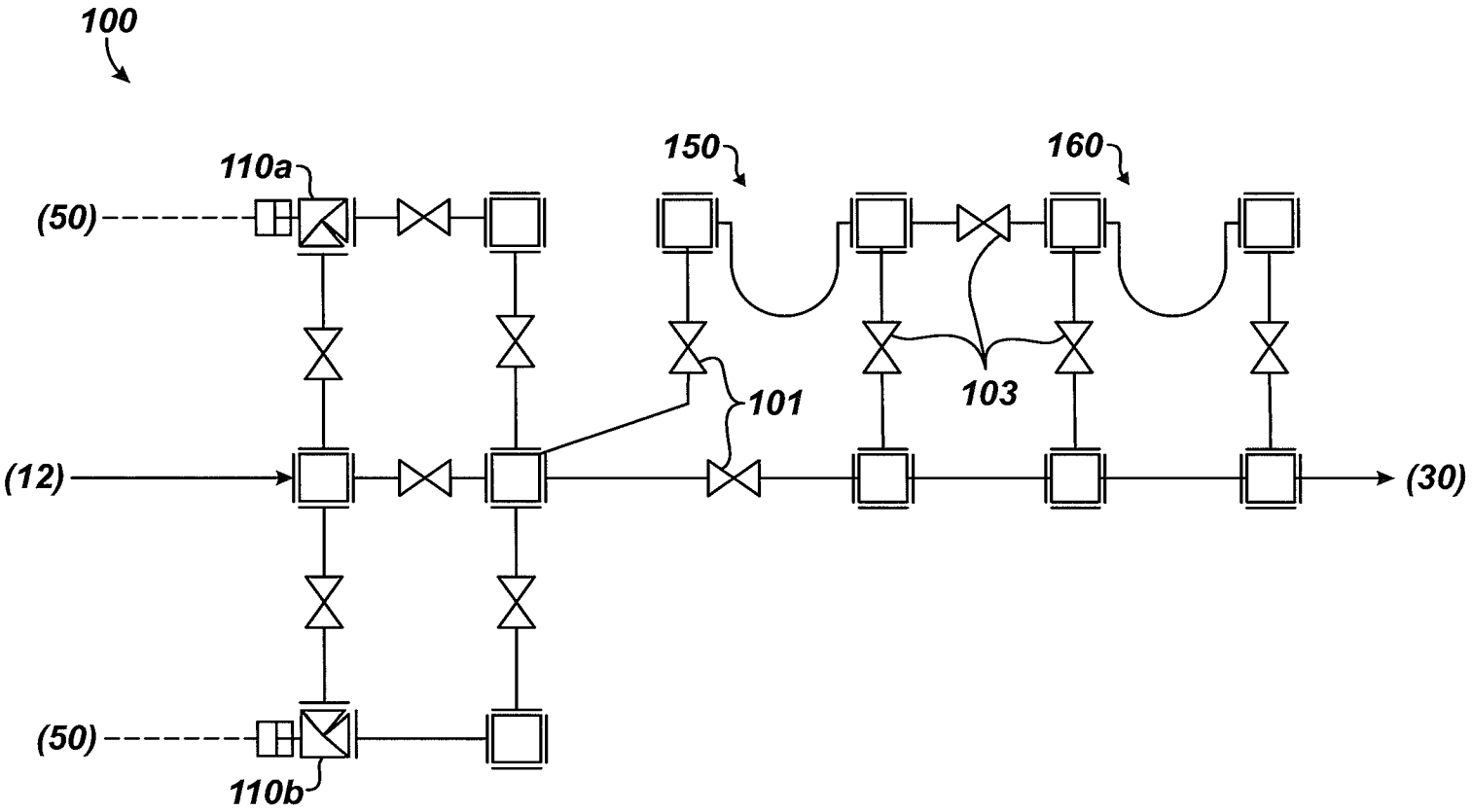
FIGS. 9A-9B illustrate schematics for choke manifolds having redundant flowmeters in series according to the present disclosure.

If the manifold 100 has redundant arrangements of flowmeters 150 in series as discussed later with reference to FIGS. 9A-9B, then the processing unit 52 can operate the redundancy control 80 for controlling and measuring with redundant flowmeters 150 in series. Details of the redundancy control 80 are provided below with reference to FIGS. 9A-9B.

If the manifold 100 has secondary chokes 120 downstream of the flowmeters 150, then the processing unit 52 can operate the cavitation control 90 for controlling the secondary chokes 120 to reduce cavitating bubbles forming in the selected flowmeters 150. In addition to what has already been discussed, details of the cavitation control 90 and use of the secondary chokes 120 are provided below with reference to FIGS. 10-11.

D. Selective Distribution Control

Figure 8:
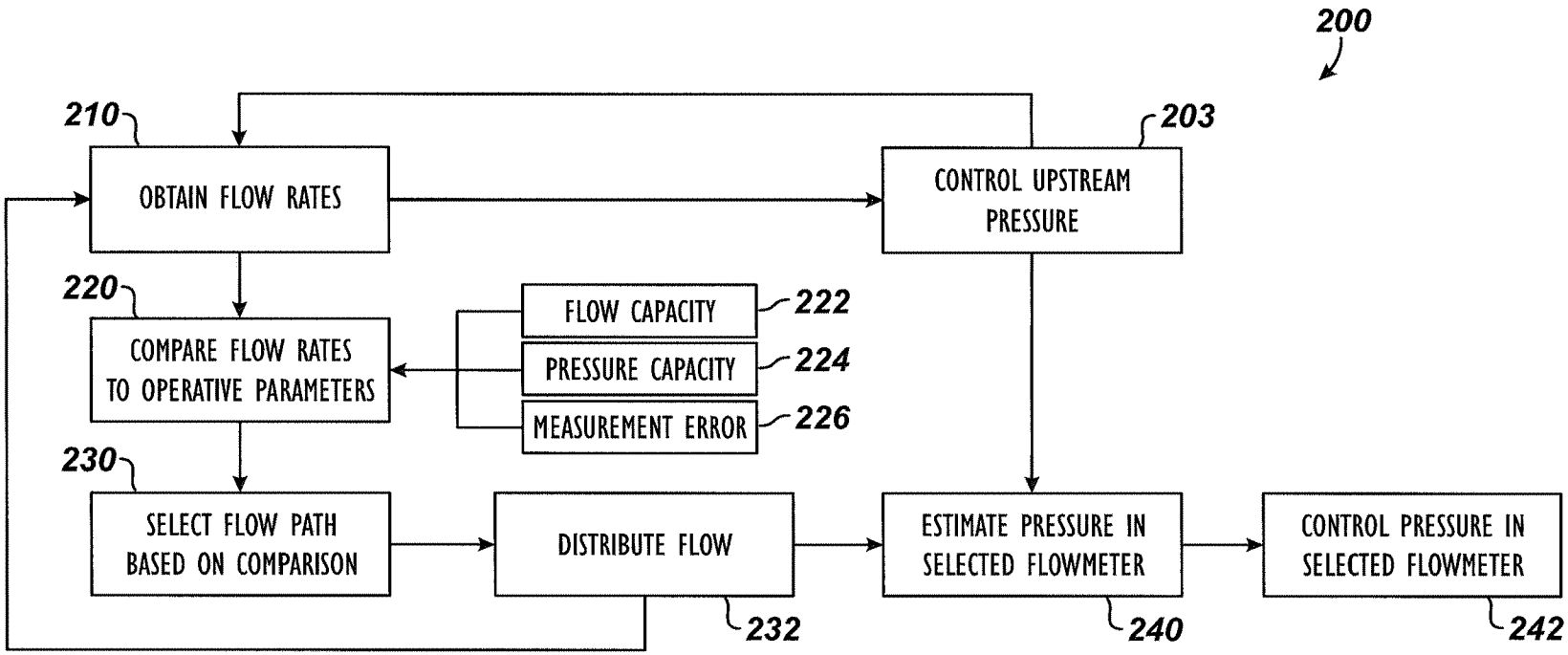
FIG. 8 illustrates a distribution control process for the disclosed control system.

FIG. 8 illustrates a selective distribution control 200 of the manifold controller (50: FIG. 7) in flowchart form. In the discussion that follows, reference is made concurrently to the elements of FIGS. 2-7. As noted herein, the valves 101, 102, 104, 105 and/or main chokes 110 of the distribution arrangement for the manifold 100 can direct flow to the appropriate size of flowmeter 150 or set of flowmeters 150 to best handle the flow and pressure capacities and to minimize the expected flow measurement error for any given flow rate.

To do this, the processing unit 52 obtains, at least periodically, flow rates of drilling fluid flow from the wellbore 16 (Block 210). The flow rates can come from current and past flow rate readings obtained from the one or more flowmeters 150 in current operation. In this way, the processing unit 52 can obtain, at least periodically, the flow rates of drilling fluid flow from the wellbore 16 by receiving feedback of the readings from the one or more currently used flowmeters 150. Alternatively, flow rate readings can come from other sources such as a multi-phase flowmeter 28 or the like in the drilling system 10.

Using the obtained flow rates, the processing unit 52 controls the upstream pressure of the drilling fluid flow based on the desired choke and well controls for managing pressure during drilling and based at least in part on readings from the one or more flowmeters 150 (Block 212). These operations can use the choke controls 60 for creating backpressure in the drilling fluid to manage pressure during drilling and handle well control events according to the MPD control system 40. Details of these operations are discussed previously and are not repeated here. In general though, these choke controls 60 operate the one or more main choke(s) 110 in the manifold 100 and are dictated by the well management needs, desired surface backpressure, kick controls, loss controls, etc. associated with the managed pressure drilling being performed.

At the same time or at least periodically, the processing unit 52 also compares the flow rates to operative parameters related at least to the flowmeters 150 and optionally the main chokes 110 or other valves of the manifold 100 (Block 220). This is done to determine whether the current flowmeters 150 being used to monitor the flow are best suited for the current flow rate, flow pressures, etc. The operative parameters for this comparison can include the flow capacities (222), the pressure capacities (224), and the measurement errors (226) associated with each of the flowmeters 150.

In this way, the determination of which of the one or more flowmeters 150 to select for distribution can use the obtained flow rate and pressure in comparison to flow and pressure capacities for each of the flowmeters 150. These capacities (222, 224) in turn are directly associated with known measurement errors (226) for the flowmeters 150. The correlation of these parameters can then be used to select which of the flowmeters 150 is best suited for the current flow conditions.

As an alternative, proactive inputs from the MPD control system 40 or elsewhere may dictate which of the flowmeters 150 to select. Such proactive inputs can be based on expected conditions or current operations.

In the end, selectively distributing the drilling fluid flow through the one or more flowmeters 150 seeks to minimize the overall measurement errors (226) in the obtained readings from the one or more selected flowmeters 150. In one particular consideration to achieve this, the processing unit 52 can compare the obtained flows rate to the measurement error associated with each of the flowmeters 150 and select the combination of those flowmeters 150 that minimizes the overall error.

Based on the comparisons noted above, the processing unit 52 determines which of the one or more flowmeters 150 to select as a flow path for flow distribution (Block 230), and the processing unit 52 then selectively distributes the drilling fluid flow through one or more of the flowmeters 150 as selected (Block 232). Depending on the distribution arrangement of the manifold 100, selecting the distribution of the flow can involve actuating a valve (101, 102, 104, and 105) and/or actuating a choke (110) to direct drilling fluid flow through a selected flowmeter 150.

For example, in the distribution arrangement of FIGS. 3-5, selecting to distribute flow through a given flowmeter 150 can involve actuating a respective choke 110 for the given flowmeter 150 should the leg's valves 101, 102 be open. Alternatively, should the leg's valves 101, 102 be actuatable in the distribution arrangement of FIGS. 3-5, selecting to distribute flow through a given flowmeter 150 can involve actuating the leg's valves 101, 102. As another example, in the distribution arrangement of FIG. 6, selecting to distribute flow through a given flowmeter 150 can involve actuating the respective leg's valves 104, 105 since selection of the flowmeter 150 is independent of the operation of the shared chokes 110.

Because using the choke(s) 110 to control pressure has a direct effect on the flow rates and pressures through the flowmeters 150 and in some arrangements can even dictate which flowmeter 150 receives flow, the process of selecting the flow path through which flowmeter 150 based on flow rates (Block 230) can be performed in conjunction with the process of controlling the upstream pressure with the chokes 110 (Block 212). Alternatively, a serial arrangement of the process 200 can be used in which the upstream pressure is controlled with the chokes 110 (Block 212) and then flow paths are selected (Block 230) or in which the flow paths are selected (Block 230) and then the upstream pressure is controlled with the chokes 110 (Block 212).

In this sense, by operating the one or more valves and/or chokes (101, 102, 104, 105, 110), the processing unit 52 can control the upstream pressure in the drilling fluid flow (Block 212) concurrently with the selective distribution of the drilling fluid flow through the one or more of the plurality of the flowmeters 150 (Block 230). Alternatively, by operating the one or more valves and/or chokes (101, 102, 104, 105, 110), the processing unit 52 can control the upstream pressure in the drilling fluid flow (Block 212) separately from the selective distribution through the one or more of the plurality of the flowmeters 150 (Block 230).

As one example, using the obtained flow rates in comparison to flow capacities for each of the flowmeters 150, the processing unit 52 can determine when the flow rate reaches a certain threshold under the current choke controls. At that point, the processing unit 52 can actuate another valve (101, 102, 104, and 105) or choke (110) on the distribution arrangement to open and allow the flow to branch off and enter another flowmeter 150 to allow the higher flow rate to pass through. This may dictate some readjustment of the choke controls 60 for the operative chokes 110.

With the flow distributed as selected, the process 200 feeds back to obtaining flow rates (Block 210) for both controlling upstream pressure for the choke controls 60 (Block 212) and comparing flow rates and selecting flow paths (Blocks 220-230).

As one example to distribute the drilling fluid flow, the processing unit 52 can distribute the fluid flow through a first of the one or more flowmeters 150*a* based on a first level of the obtained flow rates and can distribute the drilling fluid flow through a second of the one or more flowmeters 150*b* and not the first flowmeter 150*a* based on a second level of the obtained flow rates. The first flowmeter 150*a* can have a first flow capacity, and the second flowmeter 150*b* can have a second flow capacity greater or less than the first flow capacity.

As another example to distribute the drilling fluid flow, the processing unit 52 can distribute the drilling fluid flow through a first of the one or more flowmeters 150*a* based on a first level of the obtained flow rates and can distribute the drilling fluid flow through the first flowmeter 150*a* and a second of the one or more flowmeters 150*b* based on a second level of the obtained flow rates. The first flowmeter 150*a* can have a first flow capacity, and the second flowmeter 150*b* can have a second flow capacity, which can be the same or different to the first flow capacity.

As will be appreciated with the benefit of the present disclosure, other examples to distribute the drilling fluid flow can be expanded upon when more than two flowmeters 150 are used. Accordingly, the selections discussed above can be expanded with more flowmeters 150 and additional flow capacities. Pressure capacities and measurement errors can also be used for comparative purposes as disclosed herein.

In summary, accomplishing the flow routing to minimize flow measurement error in real time is dependent on a relation of total flow and measurement accuracy (error) compared to the array of flowmeters 150 available. This is done by comparing what flow capacity is needed, what flowmeters are in use or are available for use, and what the measurement accuracies (errors) of the flowmeters are. Then, the distribution to the flowmeters is optimized based on the comparisons to minimize flow measurement error.

Accomplishing the flow routing is also integrated into the MPD choke control 60 and uses pressure feedback. This is done by comparing what flow capacity is needed, what flowmeters 150 are in use or are available for use, and what surface backpressure is need for operations. Then, the distribution to the flowmeters 150 using the main chokes 110 is optimized based on the comparisons to produce the desired surface backpressure.

To handle the flow paths after distributing the flow to selected flowmeters 150 (Block 232), the processing unit 52 can additionally estimate or obtain the pressures of the drilling fluid flow in the selected flowmeters 150 (Block 240). Based on this, the processing unit 52 can control the pressures in the selected flowmeters 150 by operating a shared or in series secondary choke(s) 120 downstream of the flowmeters 150 (Block 242). As noted above for example, a choke 120 can be placed after each of the flowmeters 150 connected in parallel to increase the pressure inside each flowmeter 150 and reduce the effects of gas separation on the flowmeter's accuracy. Alternatively, several flowmeters 150 can share a common downstream choke 120. As noted herein, operating the downstream choke 120 can prevent fluid from coming out of solution in the flowmeters 150, which can undermine their abilities of reading. Further details of this control are discussed later.

E. Types of Flowmeters

Various types of flowmeters 150 can be used for the manifold 100, and selection of the flowmeters 150 according to the controls disclosed herein can use the benefits of the various types of flowmeters 150 in the manifold 100. As disclosed herein, for example, the manifold 100 can use one or more Coriolis flowmeters, which can measure the mass flow rate of a medium flowing through piping. The medium flows through a flow tube inserted in line in the piping and is vibrated during operation so that the medium is subjected to Coriolis forces. From these forces, inlet and outlet portions of the flow tube tend to vibrate out of phase with respect to each other, and the magnitude of the phase differences provides a measure for deriving the mass flow rate.

Use of the Coriolis flowmeter can provide a number of advantages. The Coriolis flowmeter is not restricted to measuring only one particular type of fluid, and the Coriolis flowmeter can measure slurries of gas and liquids without changes in properties (temperature, density, viscosity, and composition) affecting the meter's performance. Additionally, the Coriolis flowmeter uses flow tubes and does not require mechanical components to be inserted in the harsh flow conditions of the drilling fluid.

For high-pressure applications, the manifold 100 can use one or more turbine flowmeters instead of a Coriolis flowmeter to make the desired measurements. The accuracy of the turbine flowmeter at measuring a full range of flow rates may be inferior to a Coriolis flowmeter. In fact, managed pressure drilling typically requires a high level of flow-measurement accuracy so that use of the turbine flowmeter may not be acceptable at least at some flow rates. Yet, the turbine flowmeter may provide acceptable readings at higher flow rates not suited for a Coriolis flowmeter in the manifold 100.

The manifold 100 may also use other types of flowmeters with a higher-pressure rating than a Coriolis flowmeter. For example, the manifold 100 can use one or more V-cone flowmeters. A V-cone flowmeter can be rated up to 10,000 psi, whereas current Coriolis flowmeter in use may only be rated to 1850 psi.

As an example, the manifold 100 can use a set of smaller V-cone flowmeters in parallel on the manifold 100. Each V-cone flowmeter can be internally adjusted to have the highest accuracy for a given flow rate. For instance, the manifold 100 of FIG. 4 can have a set of three 4 1/16-in V-cone flowmeters 150*a-c*. The first V-cone flowmeter 150*a* can be internally designed to measure 50 to 200-GPM with the highest accuracy. The second V-cone flowmeter 150*b* can handle 200 to 400-GPM, while the third V-cone flowmeter 150*c* can measure 400 to 600-GPM.

All three V-cone flowmeters 150*a-c* together can measure up to 1200-GPM with high accuracy between 50 to 1200-GPM. The drilling chokes 110*a-c* in front of each V-cone flowmeter 150*a-c* can allow for the proper throttling of flow between the V-cone flowmeters 150*a-c* while also controlling wellbore pressure.

The manifold 100 may also use different styles of Coriolis flowmeters. For instance, the manifold 100 can use one or more straight-tube style Coriolis flowmeter with a high-pressure rating instead of the conventional curved-tube Coriolis flowmeter. The Coriolis flowmeter with a straight-tube style tends to be less accurate at lower flow rates than Coriolis flowmeters with the large curved tube. Nevertheless, a straight-tube Coriolis flowmeter can be used in a distribution with a curved-tube Coriolis flowmeter. In addition, a combination of smaller straight-tube Coriolis flowmeters can be used in the arrangement and can match the accuracy of a single curved-tube Coriolis flowmeter while raising the pressure rating to match the rest of the manifold 100.

Finally, the various flowmeters 150 and/or chokes 110, 120 for the manifold 100 can be packaged in individual containers or frames. The positive isolation system, typically gate or ball valves, for the manifold 100 can be packaged external to these containers or frames. In this way, the footprint of the MPD manifold 100 can be reduced, making the manifold 100 easier to position on a drilling rig floor. A system of modular skids as shown and described (e.g., a positive isolation skid and choke and flow measurement skids with the same or different flowmeters 150) would enable relative efficiency of manufacture, deployment, and service even when offering MPD control customized for a particular rig and/or drilling plan.

F. Redundant Flowmeters

In other arrangements, choke manifolds 100 of the present disclosure can have redundant flowmeters disposed in series, and the controller (50) can use the redundancy control (80) to monitor and route flow. For example, FIG. 9A illustrates a schematic for a choke manifold 100 having redundant flowmeters 150, 160 disposed in series downstream of shared choke(s) 110*a-b*. The flowmeters 150, 160 can be the same or different from one another and can be operated at the same time or at different times as one another. In fact, depending on the piping and valves 101, 103 used and how they are configured at a given time, the flow can pass to the flowmeters 150, 160 in series or partially in parallel, as desired.

As one example, these flowmeters 150, 160 can be the same as one another and can operate simultaneously in order to make redundant measurements of the same flow at roughly the same time. This can provide further verification of the accuracy of the readings from the flowmeters 150, 160. If comparable readings are obtained with both flowmeters 150, 160, then the manifold controller (50) can determine that either both are operating properly or both are operating incorrectly. Chances are, however, that the former is the case. If the two flowmeters 150, 160 have readings that vary from one another to a statistically significant extent, then the manifold controller (50) can determine that one of the flowmeters 150, 160 is malfunctioning. In this case, the piping and valves 101, 103 in between the two flowmeters 150, 160 can be used to selectively route flow for metering to only one of the flowmeters 150, 160, essentially isolating the other.

Figure 9B:
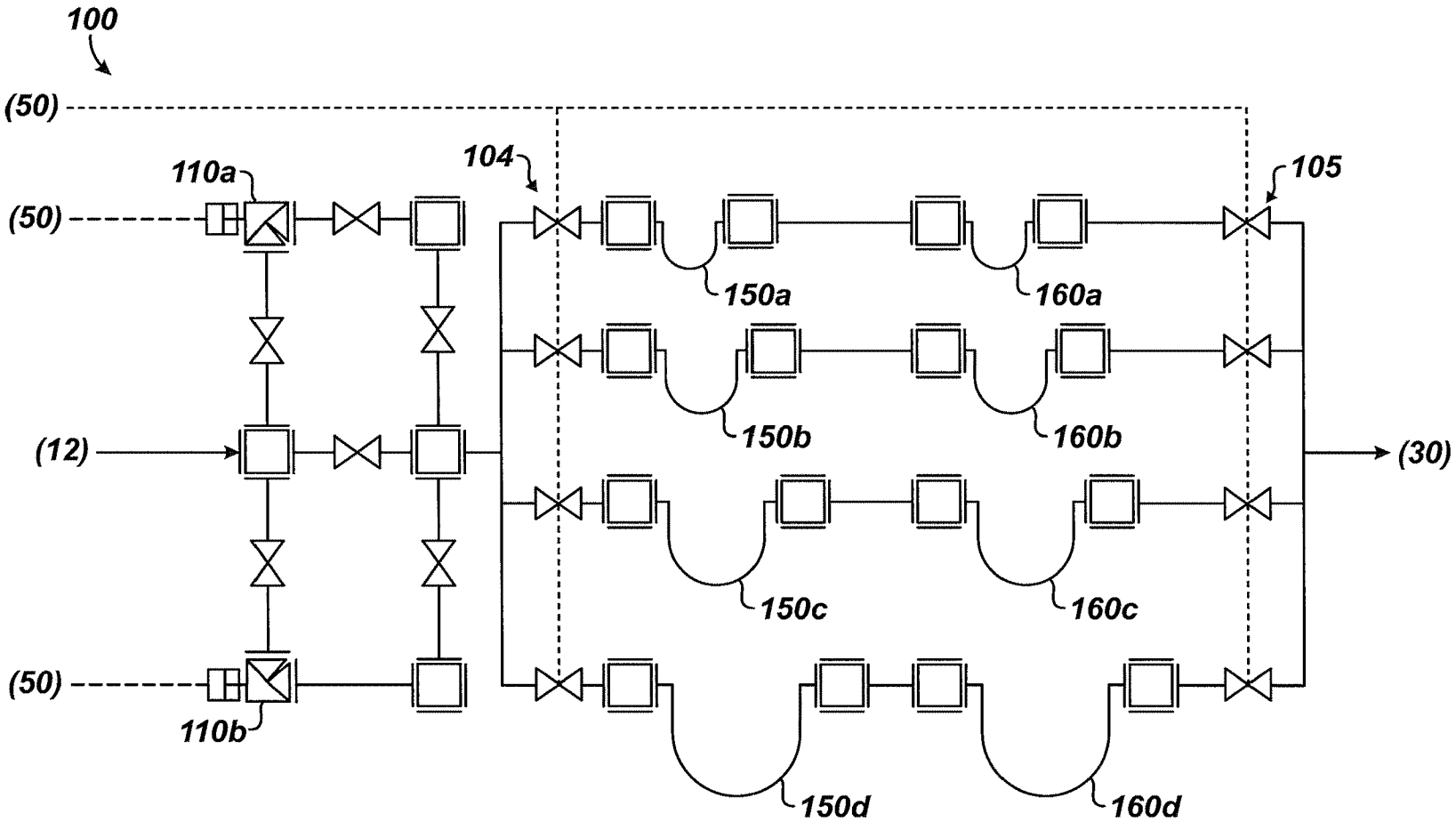

FIG. 9B illustrates a schematic for another manifold 100 having redundant flowmeters 150*a-d*, 160*a-d* for several parallel legs. For instance, each leg as depicted can have two of the same flowmeters 150*a-d*, 160*a-d* for concurrent operation and redundant readings. The various benefits of such an arrangement as in FIG. 9B follows the benefits discussed previously associated with parallel legs and redundant flowmeters 150, 160 on a leg.

As will be appreciated with the benefit of the present disclosure, any of the configurations of manifolds 100 disclosed herein having parallel flowmeters can benefit from the use of redundant flowmeters 160 as well. Therefore, each of the various configurations possible for the manifolds 100 is not outlined here, but could be configured as expected based on the teachings of the present disclosure already provided.

G. Cavitation Control

Figure 10:
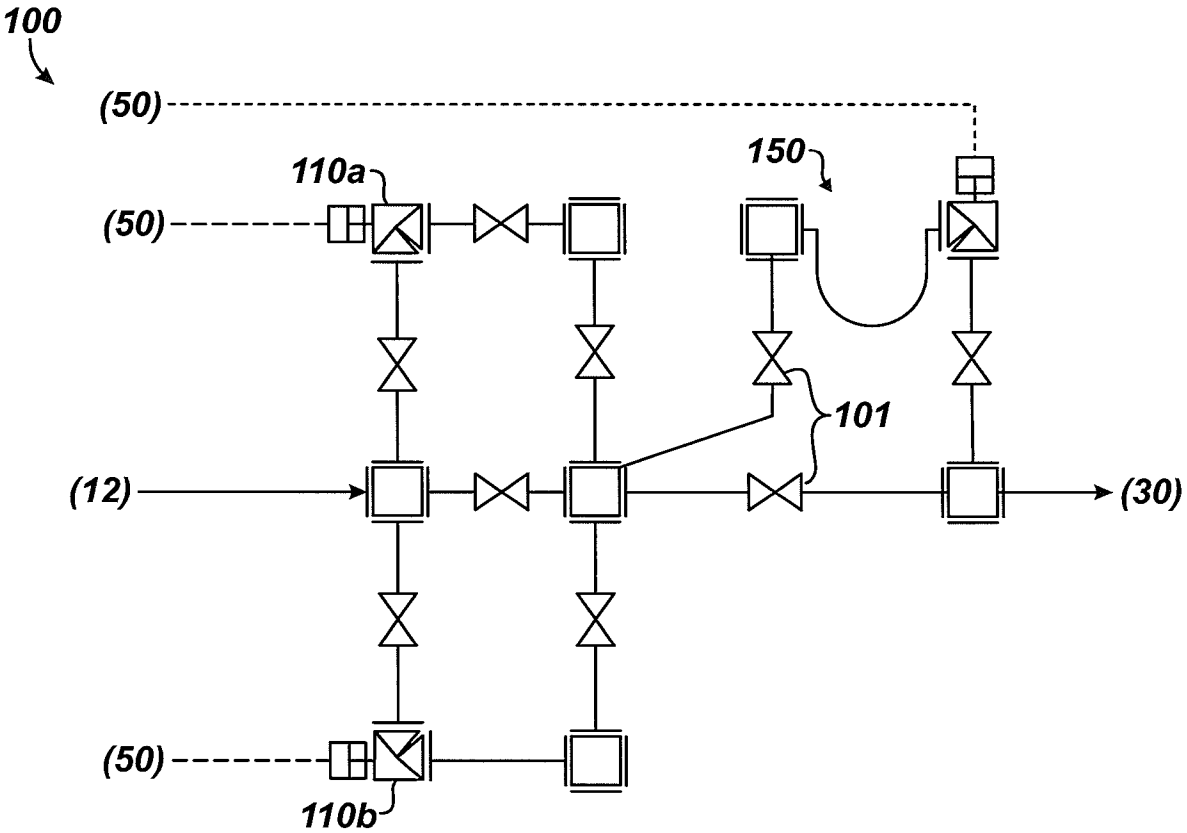
FIG. 10 illustrates a choke manifold having a choke or flow control valve downstream of the flowmeter for cavitation control.

As noted above, chokes 120, valves, orifices, and the like can be disposed downstream of one or more of the flowmeter(s) 150 to control the pressure in the flowmeter(s) 150. For example, each parallel leg in FIGS. 3, 4, etc. can have a secondary controllable choke 120. Alternatively, the set of several legs in FIG. 6 can share a secondary controllable choke 120. In fact, a choke manifold 100 having a single flowmeter 150 can have a controllable choke 120, as depicted in FIG. 10, downstream of the flowmeter 150.

For each of these arrangements of controllable choke(s) 120, the manifold controller (50) for the manifold 100 can operate the one or more controllable choke(s) 120 using the cavitation control (90) discussed briefly above. In turn, the controlled choke(s) 120 can help mitigate issues related to gasification, cavitation, flash, gas breakout, etc. that can reduce the accuracy of the flowmeter's measurements.

As noted above in FIG. 7, the cavitation control 90 can control the one or more automated valve(s) or choke(s) 120 downstream of the flowmeter(s) 150 in the manifold 100. Details of a cavitation control process 300 are provided in flow chart form in FIG. 11. For ease of discussion, reference is made to the manifold 100 in FIG. 10 having one flowmeter 150 and secondary choke 120. All the same, it will be appreciated that the cavitation control 90 disclosed herein can be equally applied and expanded to control cavitation associated with multiple flowmeters 150 and chokes 120 in parallel legs or with (multiple) flowmeters 150, 160 and chokes 110, 150, in series, as in the other embodiments disclosed herein.

Figure 11:
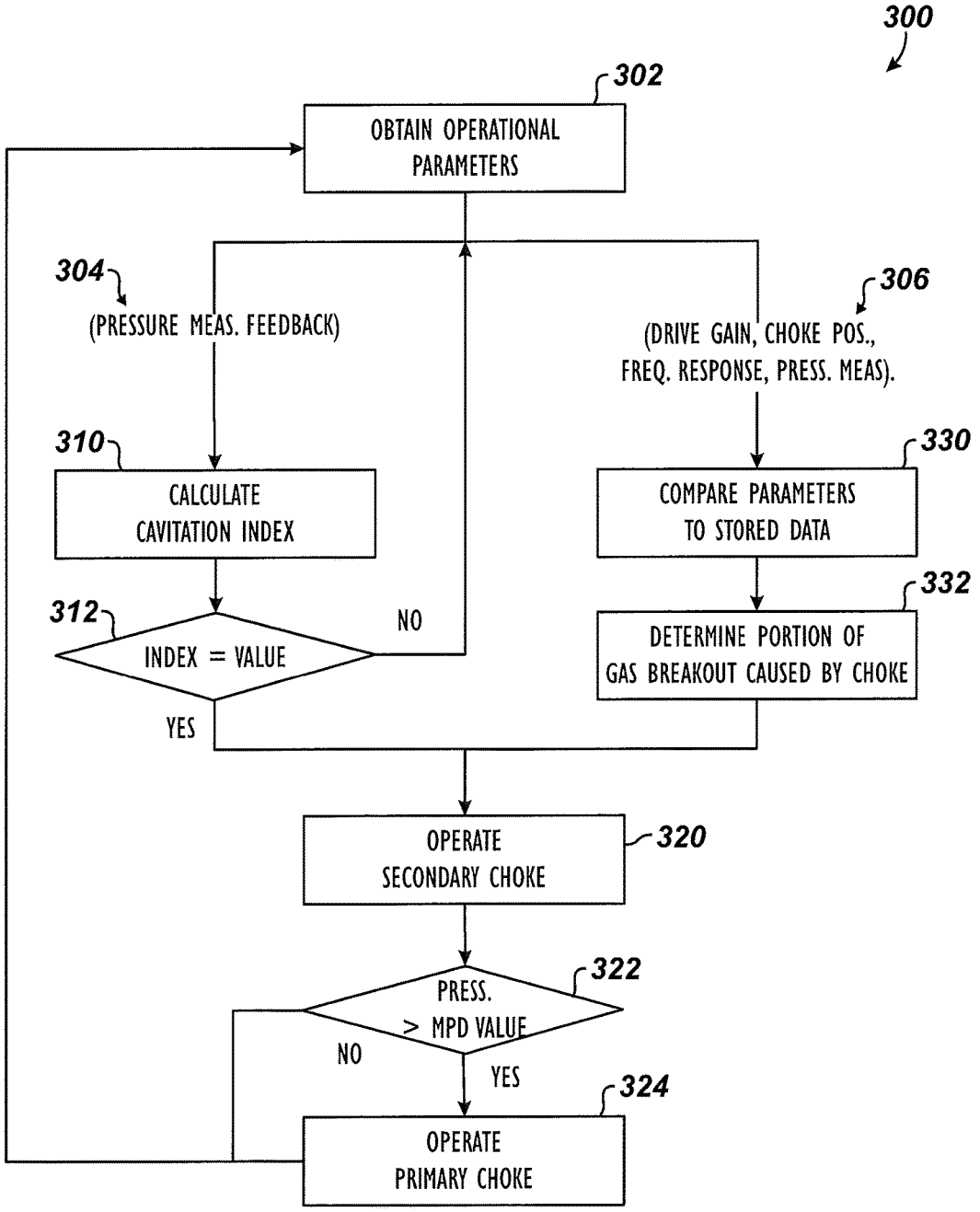
FIG. 11 illustrates a cavitation control process for the disclosed control system.

The cavitation control process 300 in FIG. 11 obtains parameters related to pressure, flow rates, flowmeter's operation, choke positions, etc. (Block 302). Using two techniques, the process 300 can rely on feedback of pressure measurements taken before and after the upstream drilling choke 110 (Block 304) and/or can rely on feedback signals related to the flowmeter 150 (Block 306).

In the first technique, upstream and downstream pressure measurements (Block 304) taken on both sides of the upstream drilling choke 110 can be applied to the formula for the cavitation index σ (Block 310). As noted previously, the cavitation index σ is a dimensionless ratio that relates upstream pressure, downstream pressure, and vapor pressure for a given temperature to characterize when cavitation and gas breakout is likely to occur.

In the process 300, the calculated index σ can be compared against an expected cavitation value of the upstream choke 110 for a given choke position of the choke 110 within the manifold controller 50 (Decision 312). When the cavitation index σ comes close to the expected cavitation value (Yes at 312), the controller 50 can operate the downstream choke 120, for example, by partially closing the downstream choke 120 to a new calculated position to reduce the chances of cavitation and gas breakout affecting the respective flowmeter 150 (Block 320).

Additionally, while the downstream choke 120 slightly closes to a new position, the upstream choke 110 may need to slightly open to counteract any concomitant rise in upstream pressure and bring the pressure back down to the value required by the main MPD control system (40). Accordingly, the cavitation control process 300 controlling the downstream choke 120 can be in communication with the main MPD control system (40), as already depicted in FIG. 7. Using this communication, the cavitation control process 300 can determine if the upstream pressure has risen beyond an accepted limit due to the closing of the downstream choke 120 (Decision 322). If so, then the upstream choke 110 is opened a calculated extent to a new position to counteract the rise in upstream pressure and bring the pressure back down to the value required by the main MPD control system 40 (Block 324).

In a second technique, the cavitation control process 300 in obtaining parameters (Block 302) can rely on the signals coming from the flowmeter 150, various pressure sensors, and choke position indicator (Block 306) as the feedback to drive the control for the secondary choke 120 downstream of the flowmeter 150. In particular, the signals from the flowmeter 150 are influenced by the quantity of gas in the fluid, and portion of the gas breakout in the flowmeter 150 may be caused by the main choke(s) 110 operation and/or may be caused by flashing or other issue.

Of course, gas at the flowmeter 150 can come from the well (i.e., from a gas kick). In this instance, how the upstream choke 110 is operated and any cavitation index related to the choke 110 may not play much of a role as to whether gas will hit the flowmeter 150 or whether the flowmeter 150 can make readings accurately. All the same, the solution to keep the flowmeter 150 operating properly is the same as disclosed herein and attempts are still made to maintain enough pressure to keep gas volume low as it flows through flowmeter 150.

The cavitation index formula also applies to such issues as cavitation, flashing, gas kick, etc. that can occur in these circumstances. As fluid with a high gas content enters the flowmeter 150, the output signals of the flowmeter 150 change. Namely, flowmeter parameters, such as the pickoff voltage, drive gain, and response frequency, for a Coriolis type flowmeter can change. Other types of flowmeters 150 other than a Coriolis flowmeter may have comparable changes in various parameters in response to higher concentrations of gas in the flow. When the fraction of gas within the fluid rises above a certain threshold, the pickoff voltages and density measurements drop, while the response frequency and drive gain increase.

These flowmeter parameters can be used to help determine when there is gas present in the flowmeter 150. More particularly, these flowmeter parameters can be used to quantify the quality of the flow and density measurements. This quantity may be controlled, within the limitations of the relationship between pressure and measurement quality as well as the burst pressure of the flowmeter.

In the end, this second technique can provide details of the quality of gas in the flowing medium, more than just the existence of gas. More specifically, the second technique can quantify the state of the mixture, which is what actually reduces the flowmeter's ability to measure density and flow. Ultimately, the signals of the flowmeter parameters from the flowmeter 150 can show when a high percentage of gas is mixed with the fluid, even though the signals alone may not be enough to differentiate between gas coming from the well, gas coming from cavitation within the chokes 110, or gas caused by flashing, elevation, etc.

Accordingly, the cavitation control process 300 attempts to determine the source of the gas that is present in the fluid. To do this, the process compares the flowmeter parameters (e.g., pickoff voltages, drive gain, and frequency response) of the flowmeter(s) 150 to empirical tables or other stored data that correlates how those signals should compare with the given choke position and pressure measurements (Block 320). This stored correlation data can be empirically compiled information obtained through testing and modeling and can be stored in lookup tables (55*b*) or other format in the controller's database (54: FIG. 7).

Based on that comparison, the controller 50 can detect which portion of the gas breakout may have been caused by the main choke(s) 110 (Block 322). For example, when the gas signals for the flowmeter(s) 150 follow in line with the expected numbers caused by movement of the main choke (s) 110, the cavitation control process 300 can differentiate between first gas that is exiting in the well and second gas that is coming from choke cavitation off the upstream choke(s) 110.

Based on knowledge of what portion of the gas breakout has been caused by the main choke(s) 110 or not, the cavitation control process 300 can operate the secondary choke accordingly (Block 320), determine if upstream pressure has changed more than a threshold (Block 322), and operate the upstream choke 110 if necessary (Block 324).

One or both of the above techniques can be used to control the second downstream choke(s) 120 and to maintain accuracy of the respective flowmeter(s) 150 by reducing the error caused by cavitation. This cavitation control process 300 can be applied to one flowmeter 150 of a manifold 100 having one or more upstream choke(s) 110 and a downstream choke 120 (e.g., FIG. 10) and likewise can be applied to the various arrangements herein having multiple chokes 110/120 and flowmeters 150/160 (e.g., FIGS. 3-6, 9A-9B).

Using the pressure ratio to determine the cavitation index listed previously offers a simplified determination that can generally be used. Overall, it is easier to measure upstream/downstream pressures, and the formula for determining the cavitation index using the measured pressures does not need to characterize extensive details of the choke valve involved. All the same, more detailed calculations can be used, such as calculations of the critical cavitation index, which can have benefits in determining onset of cavitation and flash evaporation.

As noted previously, applying backpressure with the secondary choke 120 as disclosed herein can abate the gas breakout caused by flash evaporation in addition to cavitation. As noted previously, flash evaporation results from pressure drop through a flow restriction where the downstream pressure is below vapor pressure, $\sigma<1$. Cavitation occurs within a range below some critical cavitation number and $\sigma>1$. As also noted previously, the critical cavitation index can capture the effects of local velocity and pressure gradients through the main choke 110 instead of the simple input-output cavitation index. Accordingly, the cavitation control process 300 can use these factors of critical cavitation index, vapor pressure, local velocity, pressure gradients, and the like to determine what backpressure to apply with the secondary choke 120 and abate gas breakout.

For example, the cavitation control process 300 can use a choke manufacture's values for the choke's critical cavitation index as a factor in the calculations related to cavitation and gas breakout. For example, a manufacture of a valve may assign a critical cavitation index of 2 (measured from upstream vs downstream pressure ratio) to their choke. Alternatively, a manufacturer may assign a critical cavitation index of 3.5 for 10% closed and can vary the value from 3.5 to 12 depending on valve position. The cavitation control process 300 can use these provided values.

Preferably, however, the control process 300 uses lookup tables 55*b* (e.g., graphed, charted, or tabulated data) that measure a flowmeter's performance (as it relates to quantity and quality of cavitation gas in the flowing medium) compared with the valve position and pressures measurements taken in the manifold 100. Additionally, more details of a choke valve's geometry can be considered, and the changing factors of the critical cavitation index related to the choke valve 22 can be characterized with more particularity in the lookup tables 55*b* for the flowmeter's performance.

In the situation of gas separating out after a pressure drop and not mixing back, the cavitation control process 300 can estimate how much entrained gas would be typically drawn out of solution (assuming there has not been a kick) for a given pressure drop/choke position. The estimation can be obtained using tabulated data in the lookup tables 55*b* or the like for a given fluid (water or oil-based mud) at certain measured parameters (temperature, density, pressure, etc.). In turn, the process 300 can control the secondary choke 120 in a way to mitigate the effect of gas breakout at the main choke 110. As noted previously, when the entrained gases have broken out of solution, they are less likely to mix back in to solution. Accordingly, the addition of backpressure from the secondary choke 120 can compress those gasses and raise the overall density.

Part of the control feedback loop for the process 300 can rely on the expected amount of gas breakout and subsequent compression of those gasses. The ideal gas law can be helpful for these consideration. As know, the ideal gas law can be characterized as $$P=\rho\frac{R}{M}T,$$

where P is the pressure of the gas; p is the density of the gas; M is the molar mass; R is the ideal or universal gas constant; and T is the temperature of the gas. As understood from the ideal gas law, adding backpressure with the secondary choke 120 can reduce the volume of gas and raise the overall density of the fluid/gas mix, thereby reducing the chances of gases coming out of solution.

As disclosed herein, chokes 110/120 can be used to not only control backpressure, but can be used to control flow direction (i.e., routing and opening/closing off flow). In general, the chokes 110/120 may not be capable of fully closing and may have some leakage. Therefore, it may be desirable to use ball valves instead of gate valves to control flow direction. In fact, some of the various valves 101, 102, 104, 105, etc. can be ball or gate valves automatically controlled with actuators to control flow direction according to the purposes disclosed herein.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of drilling a wellbore with a drilling system, the method comprising:

obtaining a measurement of drilling fluid flow from the wellbore through one or more of a plurality of flowmeters of the drilling system disposed in parallel communication;

controlling, with one or more valves of the drilling system, upstream pressure of the drilling fluid flow in the wellbore based at least in part on the obtained measurement by operating at least one first adjustable choke of the one or more valves, disposed in fluid communication upstream of the plurality of flowmeters, to adjust the upstream pressure; and selectively distributing, with the one or more valves, the drilling fluid flow from the wellbore through the one or more of the plurality of flowmeters of the drilling system based at least in part on the obtained measurement.

2. The method of claim 1, wherein obtaining the measurement of the drilling fluid flow from the wellbore comprises obtaining, at least periodically, the measurement from the one or more selected flowmeters.

3. The method of claim 2, wherein obtaining, at least periodically, the measurement from the one or more selected flowmeters comprises obtaining a mass flow rate of the drilling fluid flow as the measurement using the one or more selected flowmeters.

4. The method of claim 1, wherein selectively distributing the drilling fluid flow from the wellbore through the one or more of the plurality of flowmeters based at least in part on the obtained measurement comprises determining which of the one or more of the plurality of flowmeters to select for distribution by comparing a flow rate of the obtained measurement to a flow capacity of each of the flowmeters.

5. The method of claim 1, wherein selectively distributing the drilling fluid flow from the wellbore through the one or more of the plurality of flowmeters based at least in part on the obtained measurement comprises determining which of the one or more of the plurality of flowmeters to select for distribution by comparing a pressure of the obtained measurement to a pressure capacity of each of the flowmeters.

6. The method of claim 1, wherein selectively distributing the drilling fluid flow from the wellbore through the one or more of the plurality of flowmeters based at least in part on the obtained measurement comprises minimizing a measurement error of the measurement obtained with the one or more of the plurality of flowmeters.

7. The method of claim 6, wherein minimizing the measurement error comprises determining which of the one or more of the plurality of flowmeters to select for distribution by comparing the obtained measurement to the measurement error of each of the flowmeters.

8. The method of claim 1, wherein controlling the upstream pressure and selectively distributing the drilling fluid flow comprises controlling the upstream pressure of the drilling fluid flow in the wellbore concurrently with the selective distribution of the drilling fluid flow through the one or more of the plurality of flowmeters.

9. The method of claim 1, wherein controlling the upstream pressure and selectively distributing the drilling fluid flow comprises controlling the upstream pressure of the drilling fluid flow in the wellbore separately from the selective distribution through the one or more of the plurality of flowmeters.

10. The method of claim 1, further comprising adjusting internal pressure at least inside at least one of the one or more selected flowmeters using at least one second adjustable choke of the valves, disposed in fluid communication downstream of the at least one selected flowmeter, in response to the adjustment of the at least one first adjustable choke.

11. The method of claim 10, further comprising readjusting the at least one first adjustable choke in response to the adjustment of the at least one second adjustable choke.

12. The method of claim 10, wherein adjusting the internal pressure at least inside the at least one selected flowmeter using the at least one second adjustable choke comprises determining a portion of gas breakout in the at least one selected flowmeter caused by the at least one first adjustable choke and adjusting the at least one second adjustable choke based on the determination.

13. The method of claim 12, wherein determining the portion of the gas breakout in the at least one selected flowmeter caused by the at least one first adjustable choke comprises comparing one or more operational parameters of the at least one selected flowmeter to empirical information associated with the at least one selected flowmeter.

14. The method of claim 10, wherein adjusting the internal pressure at least inside the at least one selected flowmeter using the at least one second adjustable choke comprises calculating a cavitation index based on pressure measured relative to the at least one selected flowmeter and determining that the cavitation index differs from an expected valve for the cavitation index for a current position of the at least one first adjustable choke.

15. The method of claim 1, wherein selectively distributing, with the one or more valves, the drilling fluid flow through the one or more of the plurality of flowmeters of the drilling system based at least in part on the obtained measurement comprises distributing the drilling fluid flow through a first of the one or more selected flowmeters, having a first capacity, based on a first level of the obtained measurement and distributing the drilling fluid flow through a second of the one or more selected flowmeters, having a second capacity for the second flowmeter different from the first capacity, and not the first flowmeter based on a second level of the obtained measurement.

16. The method of claim 1, wherein selectively distributing the drilling fluid flow through the one or more of the plurality of flowmeters of the drilling system based at least in part on the obtained measurement comprises distributing the drilling fluid flow through a first of the one or more selected flowmeters, having a first capacity, based on a first level of the obtained measurement and distributing the drilling fluid flow through the first flowmeter and a second of the one or more selected flowmeters, having a second capacity the same as or different from the first capacity, based on a second level of the obtained measurements.

17. The method of claim 1, wherein obtaining the measurement of the drilling fluid flow from the wellbore through the one or more of the plurality of flowmeters of the drilling system disposed in parallel communication comprises:

obtaining, at least periodically, a first reading of the drilling fluid flow from the wellbore with a first of the flowmeters of the drilling system;

obtaining, at least periodically, at least one second reading of the drilling fluid flow from the wellbore with at least one second flowmeter of the drilling system disposed in series communication with the first flowmeter; and comparing the first and at least one second readings with one another; and wherein controlling the upstream pressure comprises controlling, with the at least one first adjustable choke of the drilling system, the upstream pressure in the drilling fluid flow based at least in part on the comparison.

18. The method of claim 1, wherein controlling the upstream pressure of the drilling fluid flow in the wellbore based at least in part on the obtained measurement comprises controlling surface backpressure of the drilling fluid flow in the wellbore using the obtained measurement as feedback to control the drilling of the wellbore.

19. An apparatus for controlled pressure drilling of a wellbore, the apparatus comprising:

a plurality of flowmeters in parallel fluid communication; and a distributor in fluid communication between the wellbore and the plurality of flowmeters and operable to selectively direct drilling fluid flow from the wellbore to one or more of the plurality of flowmeters, wherein the distributor comprises a plurality of first valves each in fluid communication upstream of a respective one of the flowmeters, and wherein each of the first valves is operable to control upstream pressure in the drilling fluid flow.

20. The apparatus of claim 19, wherein the flowmeters each comprise a same flow capacity or comprise at least two different flow capacities; and wherein the flowmeters comprise a same type of flowmeter device or comprise at least two different types of flowmeter device.

21. The apparatus of claim 19, further comprising a plurality of second valves each in fluid communication downstream of a respective one of the flowmeters, each of the second valves being operable to control internal pressure in the respective one of the flowmeters.

22. The apparatus of claim 19, wherein the distributor comprises at least one second valve in fluid communication downstream of one or more of the flowmeters, the at least one second valve being operable to control internal pressure inside the respective one or more of the flowmeters.

23. The apparatus of claim 19, further comprising a control in operable communication with the distributor and operating the distributor to selectively direct the drilling fluid flow to the one or more flowmeters.

24. The apparatus of claim 23, wherein the control obtains a measurement of the drilling fluid flow and operates the distributor in accordance with the obtained measurement.

25. The apparatus of claim 19, wherein at least one of the first valves in fluid communication with the drilling fluid flow from the wellbore is operable with first states to control the upstream pressure of the drilling fluid flow;

wherein a first of the one or more selected flowmeters in fluid communication downstream of the at least one first valve is operable to measure a first reading of the drilling fluid flow past the first flowmeter;

wherein at least one second flowmeter in series communication downstream of the first flowmeter is operable to measure at least one second reading of the drilling fluid flow past the second flowmeter; and wherein the apparatus comprises a control in operable communication with the first and the at least one second flowmeters and comparing the first and the at least one second readings, the control controlling the first state of the at least one first valve based at least in part on the comparison.

26. An apparatus for controlled pressure drilling of a wellbore, the apparatus comprising:

a plurality of flowmeters in parallel fluid communication;

a distributor in fluid communication between the wellbore and the plurality of flowmeters and operable to selectively direct drilling fluid flow from the wellbore to one or more of the plurality of flowmeters;

one or more first valves in fluid communication with the drilling fluid flow; and a control in operable communication with the flowmeters and the one or more first valves, the control obtaining a reading from the one or more selected flowmeters and controlling, with the one or more first valves, upstream pressure in the drilling fluid flow based at least in part on the obtained reading.

27. The apparatus of claim 26, wherein the control is in operable communication with the distributor and operates the distributor in conjunction with the one or more first valves to selectively direct the drilling fluid flow to the one or more flowmeters using the obtained reading.

28. The apparatus of claim 26, wherein at least one of the one or more first valves in fluid communication with the drilling fluid flow of the wellbore is operable with first states to control the upstream pressure of the drilling fluid flow;

wherein at least one of the one or more selected flowmeters in fluid communication downstream of the at least one first valve is operable to measure the drilling fluid flow past the at least one selected flowmeter;

wherein at least one second valve in fluid communication downstream of the at least one selected flowmeter is operable with second states to control an internal pressure of the drilling fluid flow at least in the at least one selected flowmeter; and wherein the control is in operable communication with the at least one second valve and automatically adjusts the second state of the at least one second valve based on a cavitation value associated with the first state of the at least one first valve.

29. The apparatus of claim 26, further comprising a plurality of second valves each in fluid communication downstream of a respective one of the flowmeters, each of the second valves being operable to control internal pressure in the respective one of the flowmeters.

30. A method of drilling a wellbore with a drilling system, the method comprising:

obtaining a measurement of drilling fluid flow from the wellbore;

controlling, with one or more first valves of the drilling system, upstream pressure of the drilling fluid flow in the wellbore based at least in part on the obtained measurement; and selectively distributing the drilling fluid flow from the wellbore through one or more of a plurality of flowmeters based at least in part on the obtained measurement by comparing a pressure of the obtained measurement to a pressure capacity of each of the flowmeters and determining which of the one or more of the plurality of flowmeters to select for distribution based on the comparison.

31. The method of claim 30, wherein controlling the upstream pressure and selectively distributing the drilling fluid flow comprises controlling the upstream pressure of the drilling fluid flow in the wellbore concurrently with the selective distribution of the drilling fluid flow through the one or more of the plurality of flowmeters.

32. The method of claim 30, wherein controlling the upstream pressure and selectively distributing the drilling fluid flow comprises controlling the upstream pressure of the drilling fluid flow in the wellbore separately from the selective distribution through the one or more of the plurality of flowmeters.

33. The method of claim 30, further comprising adjusting internal pressure at least inside the one or more selected flowmeters using at least one second valve downstream of the one or more selected flowmeters in response to the control of the upstream pressure of the drilling fluid flow with the one or more first valves upstream of the one or more selected flowmeters.

34. The method of claim 30, wherein selectively distributing the drilling fluid flow through the one or more of the plurality of flowmeters of the drilling system based at least in part on the obtained measurement comprises distributing the drilling fluid flow through a first of the one or more selected flowmeters, having a first of the pressure capacity, based on a first level of the obtained measurement and distributing the drilling fluid flow through a second of the one or more selected flowmeters, having a second of the pressure capacity for the second flowmeter different from the first pressure capacity, and not the first flowmeter based on a second level of the obtained measurement.

35. The method of claim 30, wherein selectively distributing the drilling fluid flow through the one or more of the plurality of flowmeters of the drilling system based at least in part on the obtained measurement comprises distributing the drilling fluid flow through a first of the one or more selected flowmeters, having a first pressure capacity, based on a first level of the obtained measurement and distributing the drilling fluid flow through the first flowmeter and a second of the one or more selected flowmeters, having a second pressure capacity for the second flowmeter the same as or different from the first pressure capacity, based on a second level of the obtained measurements.

36. An apparatus for controlled pressure drilling of a wellbore, the apparatus comprising:

a plurality of flowmeters in parallel fluid communication; and a distributor in fluid communication between the wellbore and the plurality of flowmeters and operable to selectively direct drilling fluid flow from the wellbore to one or more of the plurality of flowmeters, the distributor comprising:

a plurality of first valves each in fluid communication upstream of a respective one of the flowmeters; and a plurality of second valves each in fluid communication downstream of a respective one of the flowmeters, each of the second valves being operable to control pressure in the respective one of the flowmeters.

37. The apparatus of claim 36, wherein each of the first valves is operable to control upstream pressure in the drilling fluid flow.

38. The apparatus of claim 36, further comprising a control in operable communication with the distributor and obtaining a measurement of the drilling fluid flow, the controller operating the distributor to selectively direct the drilling fluid flow to the one or more flowmeters in accordance with the obtained measurement.

39. The method of claim 38, wherein adjusting the internal pressure at least inside the at least one selected flowmeter using the at least one second valve comprises:

estimating cavitation in the drilling fluid flow through the at least one selected flowmeter caused by the at least one first valve; and adjusting, based on the estimated cavitation, the internal pressure of the drilling fluid flow within the at least one selected flowmeter with the at least one second valve of the drilling system in downstream communication with the at least one selected flowmeter.

40. A method of drilling a wellbore with a drilling system, the method comprising:

obtaining a measurement of drilling fluid flow from the wellbore;

controlling, with one or more valves of the drilling system, upstream pressure of the drilling fluid flow in the wellbore based at least in part on the obtained measurement by operating at least one first of the one or more valves upstream of at least one of the one or more selected flowmeters to adjust the upstream pressure;

selectively distributing the drilling fluid flow from the wellbore through one or more of a plurality of flowmeters of the drilling system based at least in part on the obtained measurement; and adjusting internal pressure at least inside the at least one selected flowmeter using at least one second of the valves downstream of the at least one selected flowmeter in response to the adjustment of the at least one first valve.

* * * * *